US006085735A

United States Patent [19]

Cheek, Jr.

[11] Patent Number: 6,085,735

[45] Date of Patent: Jul. 11, 2000

[54] DEVICE FOR PROJECTING TENNIS BALLS

[76] Inventor: John H. Cheek, Jr., 5001 Clonmel Rd., Nashville, Tenn. 37220

[21] Appl. No.: 09/175,044

[22] Filed: Oct. 19, 1998

[51] Int. Cl.[7] ..... F41B 11/26

[52] U.S. Cl. ..... 124/77; 124/73

[58] Field of Search ..... 124/56, 70, 71, 124/73, 77

[56] References Cited

U.S. PATENT DOCUMENTS

| | | | |
|---|---|---|---|
| 3,917,265 | 11/1975 | Schrier et al. | 124/77 X |
| 4,046,131 | 9/1977 | Clark et al. | 124/71 |
| 4,372,283 | 2/1983 | Balka, Jr. | 124/56 |

*Primary Examiner*—Robert P. Swiatek
*Attorney, Agent, or Firm*—Richard L Huff

[57] ABSTRACT

A computerized device for propelling tennis balls by pneumatic pressure. The device contains a support pad to protect the tennis court. There is a by-pass valve which, when open, allows the blower for the pneumatic system to blow continuously, thereby avoiding carbon deposits. There is a pressure tank for the build-up of pressure for the pneumatic system when the by-pass valve is closed. Course and fine pressure valves are used to control the pressure in the pressure tank within narrow limits. A hopper contains pushers which prohibit balls accumulating in areas of little motion. A carousel advances only when a ball can drop freely into the ball outlet tube. A cover over the feeder point prevents balls in the hopper from interfering with the ball in the feeder point. The ball is held in an injection area until forced through a flap door into the pressure tank and a guide channel. The injection area contains a solenoid-controlled sweep arm which controls a injector which forces the ball through the flap door. The ball is held in the barrel by impeders until a solenoid releases the impeders through a sliding sleeve. Thus, timing of the release can be controlled by computers within narrow limits. A computer-controlled spin plate can impart spin and curve properties to the ball. Computerized lateral and vertical aiming mechanisms result in concise placement of the ball. The device is suitable for training, testing and recreational purposes and is capable of simulating an actual tennis game.

21 Claims, 23 Drawing Sheets

26
30
32
36
16
12
4

38
10
24
34
22
32
26
24
25
14

36
16
6
18
8

38
20
18
4

34
32
26
30
14

108
46
206
210
212

206
208
46

210
212
206
208
228
226
46
230
232

DEVICE FOR PROJECTING TENNIS BALLS

BACKGROUND OF THE INVENTION

1. Field of the Invention

The present invention is directed to a tennis ball projecting device which is operated by computer and can vary and control the trajectory, placement, speed, spin, and timing of the projected balls.

2. Description of the Related Art

Devices for projecting balls are well known in the art.

U.S. Pat. No. 5,123,643 to Heilhecker et al teaches an apparatus which will fling a ball from a pouch powered by elastic straps. There is no disclosed manner to accurately adjust the timing of delivery of the propelled balls using this device.

U.S. Pat. No. 4,335,701 to Bozich teaches propelling a baseball by striking the ball with a plunger. All functions are manually controlled, eliminating the advantage of a single player practicing alone.

U.S. Pat. No. 4,193,591 to Paulson; U.S. Pat. No. 4,197,827 to Smith; RE30,703 to Paulson et al; U.S. Pat. No. 4,323,047 to McIntosh et al; U.S. Pat. No. 4,325,351 to Yuasa; U.S. Pat. No. 5,125,653 to Kovacs et al (the most closely related prior art known by the inventor); U.S. Pat. No. 4,442,823 to Floyd et al; U.S. Pat. No. 5,044,350 to Iwabuchi et al; U.S. Pat. No. 5,464,208 to Pierce; U.S. Pat. No. 5,178,123 to Yeh; U.S. Pat. No. 5,195, 744 to Kapp et al; and U.S. Pat. No. 5,437,261 to Paulson et al propel the ball by capturing the ball on the proximal side of two wheels which are spinning in opposite directions and using the acquired centrifugal force to propel the ball out the distal side of the wheels. The use of this method of propulsion causes a marked degradation in impact point reliability due to balls of different surface wear, diameter, and compression. Another disadvantage of the spinning wheels mode of propulsion is the accumulation around the machine of an annoying amount of fuzz from the balls. The greatest drawback to creating a realistic tennis game which is created by this method of propulsion is the difficulty of firing successive balls with an extreme difference in projection parameters within a realistic timing lapse. As an example, a timing lapse of 2.4 seconds between a hard base-line or passing shot followed by a drop shot or lob calls for a much slower velocity of the ball and requires the spinning wheels to spool down so drastically that consistency or accuracy is virtually impossible. Also, the placement of balls under identical conditions lacks consistency.

U.S. Pat. No. 3,989,245 to Augustine, Jr. et al is drawn to a computerized device for pneumatically projecting tennis balls. This device is to be used with a specially constructed enclosed court to allow ball retrieval. After the ball is introduced by a small rotating injector into the long, complicated bent tube, it is accelerated along its passage by three separate compressed air orifices, each with its own control unit. Therefore, there is no build-up of pressure behind the ball prior to its release. It is taught that the pressure regulator may be manually controlled.

U.S. Pat. No. 4,291,665 is an example of an early type of pneumatic propulsion devices for tennis balls. The machine may be programmed to oscillate from side to side. The trajectory of the balls and the location of the impact of the balls must be set by hand while the machine is inactive. The speed of the carousel governs the timing of the committed ball to proceed to a rubber bladder from which it is ejected after the build-up of a sufficient, unalterable air pressure.

Thus, there is little control over the timing of the balls and the speed of the balls leaving the device.

U.S. Pat. No. 5,496,025 to Phillips et al is directed to a pneumatic device for propelling balls of different sizes. The barrels are of different sizes for holding different sized balls. The device has a single air pressure control valve which is set manually. Apparently, the device can propel a tennis ball every 5 seconds. This time is too great if a realistic game-type situation is desired.

U.S. Pat. No. 5,257,615 to Jones teaches a pneumatic device for the propulsion of tennis balls. This device suffers from the limitation of having no controlled elevational or lateral direction capability or sequential variability. Thus, the simulation of an actual game is impossible.

U.S. Pat. No. 3,989,027 to Kahelin describes a pneumatic device for propelling balls of varying diameters. It has manually changeable barrels. Timing and pressure changes must be made manually. Directing pressure from the tank to the firing chamber is complicated in that a piston-activated sliding sleeve must be utilized to choke off air vents.

U.S. Pat. No. 5,107,820 to Salansky displays improved features over many of the aforementioned prior art devices. One of the goals of this invention is to match the pauses between the balls that are fired to the trajectory characteristics established by the firing system so that they are in keeping with an actual game of tennis. This is hoped to be accomplished by controlling the feed sequence (and thus of course, the firing sequence frequency). Thus a pause following a low, fast ball is brief, and longer after a high ball. This apparatus gives the player a more pronounced feeling that he is playing, not against a machine that delivers balls with a regular rhythm, but against live opponents. This machine uses the spinning wheels system of propulsion and is thus subject to the disadvantages enumerated earlier which are inherent in such systems. Additionally, the timing of the firing of a particular ball is directly linked to the feeder. The patent states that a variable feed sequence of the feed system is controlled as a function of the firing settings of the ball firing system. Thus the timing system of the Salansky system depends on controlling the time between ball drops from the holding mechanism. The dropped balls are then caught by the spinning wheels and propelled out of the machine. Whereas this is an improvement over other machines which have been discussed, the timing is not as precise as could be desired due to the difference in timing which occurs between dropped balls being caught by the spinning wheels.

U.S. Pat. No. 4,233,953 to Bash is indicated as being an add-on to existing machines, this device incorporates direct linkages of the rotary distributor with the discharge system and a ball fires when it drops from the hopper through an opening into the chamber and passes through a bladder (arresting device) after the build-up of sufficient pressure. The only new feature disclosed is the possibility of a manual setting of the limits of the lateral oscillation of the mechanism. As mentioned above, manual operation eliminates the possibility of a single player engaging in a realistic game.

U.S. Pat. No. 4,570,607 to Stokes discloses a pneumatic device for propelling tennis balls. The gist of the invention is a barrel which has an orbital motion and which rotates. The novelty of design consists of an unusual way to induce spin. A strip of Velcro is attached to one inner side of the tube to induce spin. Thus there is no possibility of propelling a ball without spin. Also, the elevation of the tube must be set manually.

While the above discussion is not exhaustive of the prior art devices which are stated to be useful for propelling balls, it is sufficient to point out a number of the problems existing in the art. It is the purpose of the present invention to maintain the beneficial aspects of the better devices disclosed in the prior art while overcoming their flaws.

SUMMARY OF THE INVENTION

One object of the present invention is to provide a complex, fully integrated system designed to provide a comprehensive and extensive range of options for simulating actual play against an opponent or instructor. The system of the invention may be used within wide limits of skill levels from that of beginner to that of touring professional and can offer programs from those suitable for simple repetitive practice drills up to those for actual game play with either pre-chosen or random, unpredictable shot and point sequences. The same machine can deliver ball performance required for a player of any level of ability-from a 2.5 player up to a 5.5 player and in any order or sequence. Thus, the system of this invention may be used as an instructional and training tool useful in testing and improving the skill level of players. Regarding testing, a player's rating is made by the National Tennis Rating Program (NTRP), which is implemented by the United States Tennis Association, the governing body for tennis in the United States. Ranking has been made by raters by subjectively viewing a player's reaction to balls hit by tennis players. No matter how skilled the tennis player, absolute consistency cannot be obtained by a single player. Obviously, the need for a large number of players to perform the duty of delivering a variety of shots multiplies the inconsistency which results. The results of this system has caused players to be disqualified from matches since the ratings which had been assigned to them were below that at which they actually belonged. With the device of the present invention, ratings need not be based on subjective judgment and inconsistent shots. A player's level of skill can be precisely and objectively determined by successful performance against numerous programs subtly graduated in degree of difficulty. Any certified instructor can grade a player simply by observing the mandated degree of success of that player's response to the demands of a given grading program. The same required performance can be used throughout the world. The system also possesses recreational applicability for a user, taking the place of a possibly unavailable human competitor. The entire system of this invention is a multifaceted system, but the individual components can be used singly or in conjunction with each other to satisfy the criteria or relative complexities required for any given training or practice session.

A single machine in the system of this invention is designed to simulate as closely as possible the same variety and potential sequencing of tennis ball delivery as that provided by an actual opponent. The only capability lacking in a single machine is the ability to move laterally on the tennis court. This lack of movement is addressed by the optimum configuration of machines. In this configuration, the system is composed of three pairs of separate ball-projecting machines on the baseline of the tennis court. One pair is in the center of the court and one each at the corners. Each pair consists of a top unit and a bottom unit. The top unit in each pair provides service functions and each lower unit possesses a range of simulations of more than 150 discretely different ground strokes. Thus, in the optimum configuration, the system has the potential of making 144 different serve deliveries and more than 450 ground stroke deliveries, providing a basis for realistic approximation of actual play against either a single opponent or a doubles team.

The control of all the functions of the optimum system, including the nature and timing of the individual shots within a sequence of deliveries from the separate machines, flow from a central computer (PC) to which all the individual components and any microprocessors of theirs are slaved. This PC can be embedded in one of the units or be remote. This flexibility allows for the possibility of a large training facility being able simultaneously to network, by means of multiple umbilical lines, any number of integrated assemblies or individual machines through a single in-house PC, thus serving the needs of both economy and efficiency.

Each of the three above-mentioned pairs of machines is composed of two separate ball-projecting machines which are normally physically linked together but are detachable to perform their individual roles, if so desired. One unit is a base unit with the greatest degree of potential and flexibility. The second unit is a service delivery unit. The service delivery unit may be mounted on four wheels or it may straddle the corresponding base unit and be clamped thereto.

In order to insure the high degree of accuracy of ball impact and precision of the rapid timing of ball delivery frequently required, pneumatic propulsion of the ball is utilized in all cases. In the base unit and one version of the serve unit, the ball is propelled by the air pressure which has been accumulated to a precise, discrete level prior to release. In a second version of the serve unit, the ball is propelled from the unit after injection into a moving stream of air having a high degree of force.

Each of the three base units has on its front an annunciator light with a blinking mode initiated by the PC software. Immediately after the delivery of a serve and each succeeding shot in a playing sequence, the blinking light on one of the base units indicates the source of the next shot, thus serving as a target area for the player trying to simulate a realistic game. The sequence of base unit ball releases may be predetermined by the program entered into the PC.

As an alternative to preprogramming the shot sequence, each base unit is equipped with a sensing device, e.g., a radar gun, to measure the velocity of returning balls and to determine by triangulation the base unit to which the ball is traveling. That base unit fires the next shot. The sequence of shots is thus not determined by a predetermined program, but is determined by the shot of the player. Thus, in this alternative the player, not the PC program, determines the base unit which will fire the next ball.

There may be levels of complexity of the system which are less complex than the optimum configuration. In the basic level there is a single base unit positioned on the baseline in the center of the court. This level can perform virtually all of the functions of the optimum system, but it is limited to ball delivery from the middle of the court and is incapable of providing optimum realism of service. This system contains its own internal microprocessor and thus possesses all the functions required for simulating actual play.

The next level above the basic level represents a coupling of the basic unit with a straddling service unit to enhance the performance of the serve. The service unit is slaved to the basic unit and, in one alternative, is integrated with the pneumatic pressure system of the basic unit. Alternatively, the service unit has its own propulsion system. This allows the service unit to be decoupled pneumatically but not electronically from the basic unit. In this alternative, service may be from one point on the baseline and all other shots from another. As a second alternative, the service unit may be decoupled both pneumatically and electronically from the basic unit. In this alternative, the service unit is slaved to a remote master PC.

The next more complex system contains a central basic unit in combination with one or both of the satellite corner basic units, each with or without its own service unit. In this system, the single microprocessor of any one basic unit, or even the combined microprocessors of more than one, lacks sufficient memory capacity to service all the functions of the entire combined system. Therefore, the system is served by a PC, either remotely located or as an integral component of one of the basic units.

Normally, each basic unit has its own microprocessor so that it can perform alone if necessary, or, with appropriate coupling, is serviced by input from a PC. If a potential owner knows in advance that a PC will inevitably be used anyway, a cost saving for the basic unit may be achieved by eliminating the microcomputer component and having only the requisite IO modules served by the PC.

The inclusion of a PC as an integral internal component of a basic unit, although more costly, offers significant advantages. It, as well as a remote PC, can accept input from floppy discs, providing limitless possibilities for pre-programmed shot repetitions, sequences, drills, patterns, points, games, and even sets.

BRIEF DESCRIPTION OF THE DRAWING

In FIGS. 1–6, the preferred location of the front wheels is shown by solid lines while the less preferred position is shown by dash lines.

FIGS. 12 and 13 also depict an alternative embodiment of this invention wherein the larger wheels are forwardly located.

DESCRIPTION OF THE PREFERRED EMBODIMENTS

Figures 1, 2, 3, 4, 5, 6, 7:
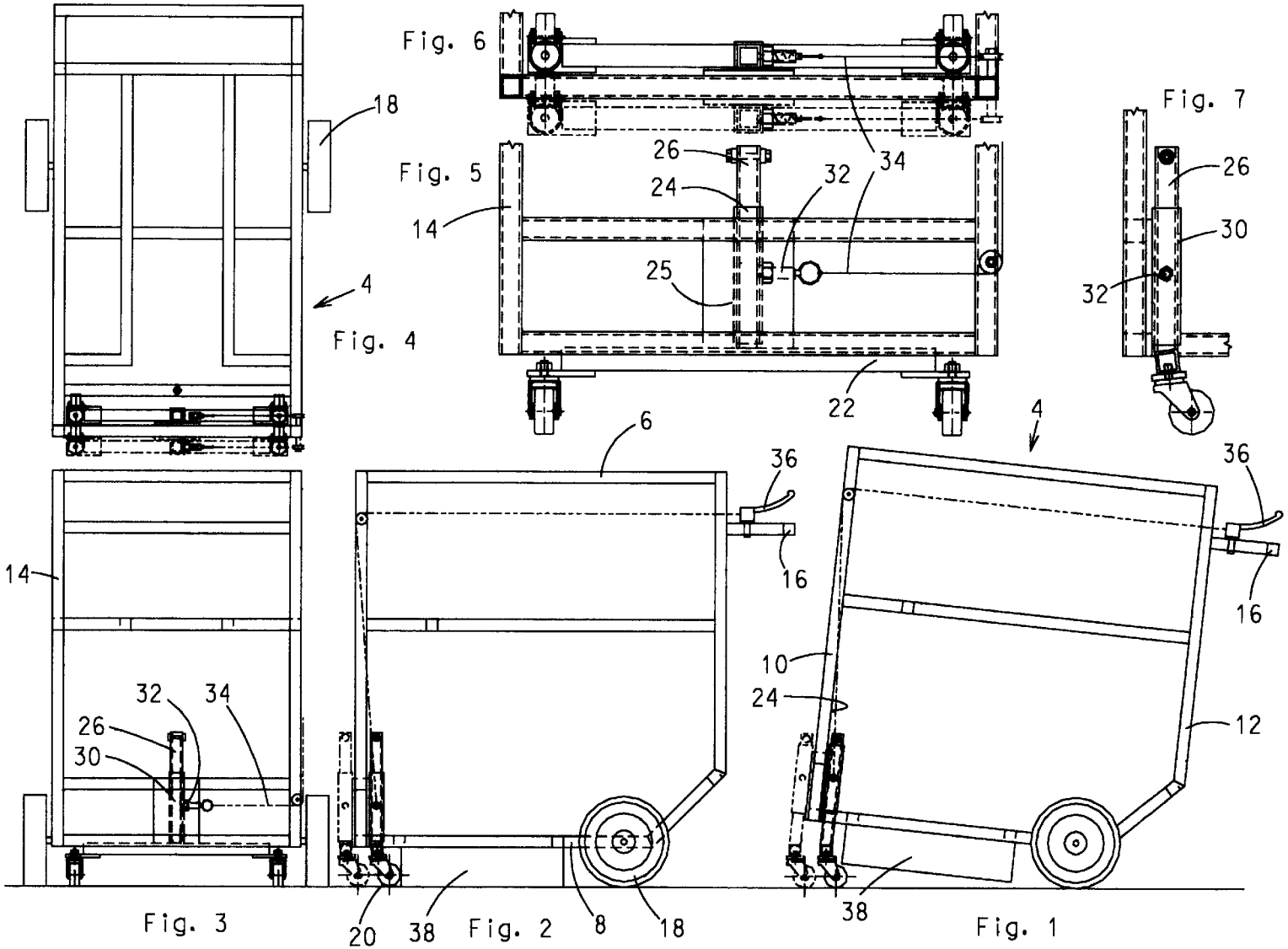
FIG. 1 is a side elevational view of the device of this invention showing it in transport position.
FIG. 2 is a side elevational view of the device of this invention showing it in operation position.
FIG. 3 is a front elevational view of the device of this invention showing the mechanism for raising and lowering the front wheels.
FIG. 4 is a top plan view of the device of this invention
FIG. 5 is a front elevational view of the lower portion of the front end of the device of this invention showing in detail the mechanism for raising and lowering the front wheels.
FIG. 6 is a top view of the front end of the device of this invention showing further detail of the mechanism for raising and lowering the front wheels.
FIG. 7 is a side elevational view of one of the front wheels of the device of this invention and its raising and lowering mechanism.
Figure 9:
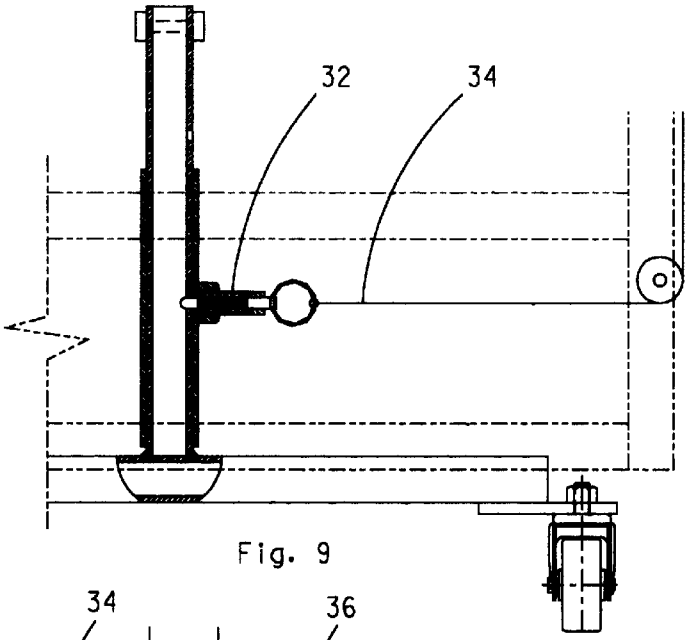
FIG. 9 is a front elevational view of the carriage, specifically showing the relationship between the locking device and the height adjusting tubes.
Figure 10:
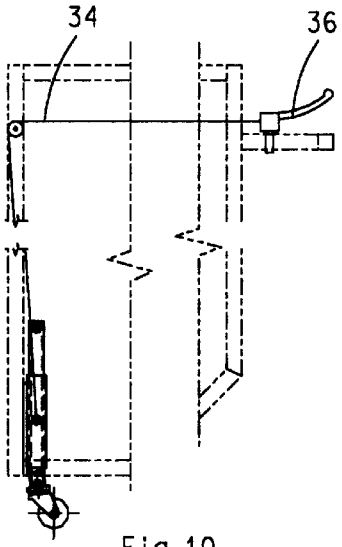
FIG. 10 is a side elevational view of the carriage, showing the entire cable control component.
Figure 11:
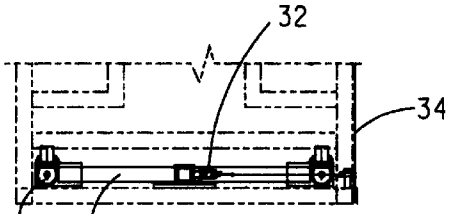
FIG. 11 is a top plan view of the front of the carriage showing the location of the wheels.
Figure 8:
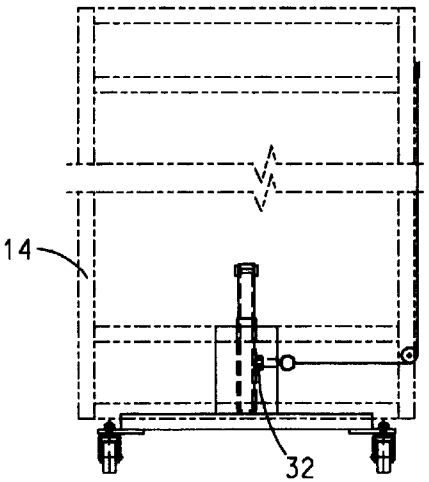
FIG. 8 is a front elevational view of the carriage, showing the relationship between the wheels and the height adjusting mechanism.
Figure 13:
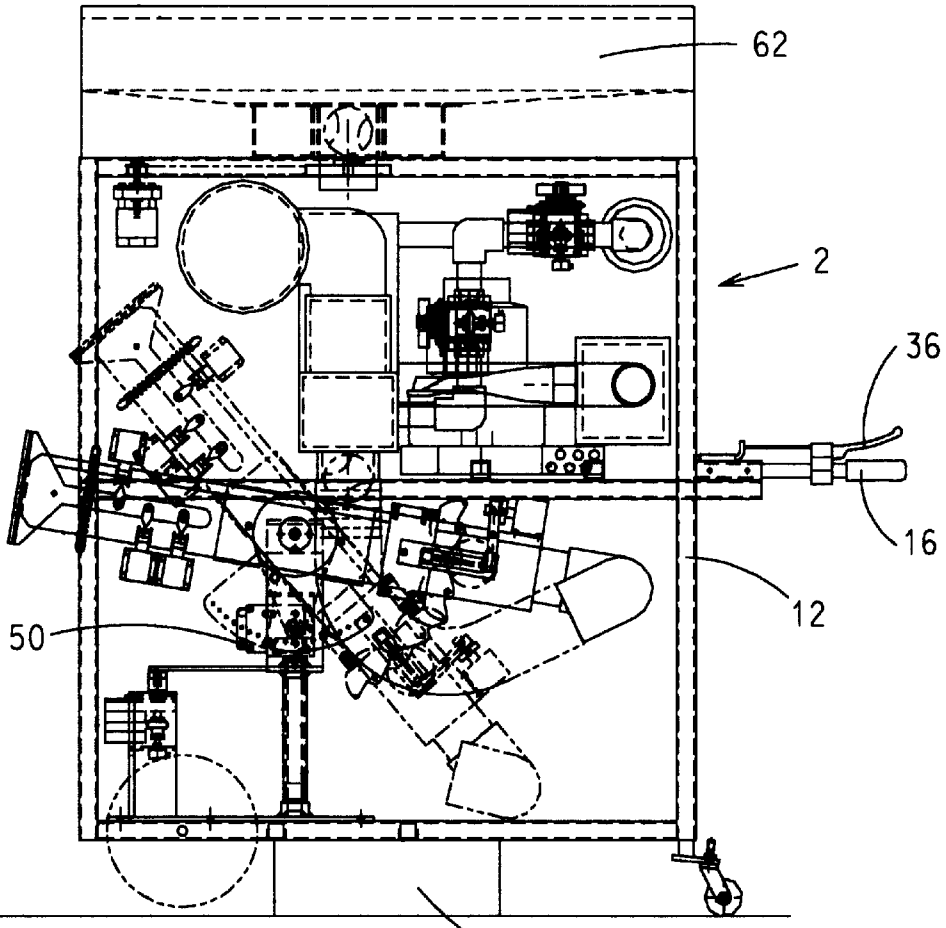
FIG. 13 is a left side cut-away view of one embodiment of the device of this invention showing the corresponding location of the components.
Figure 12:
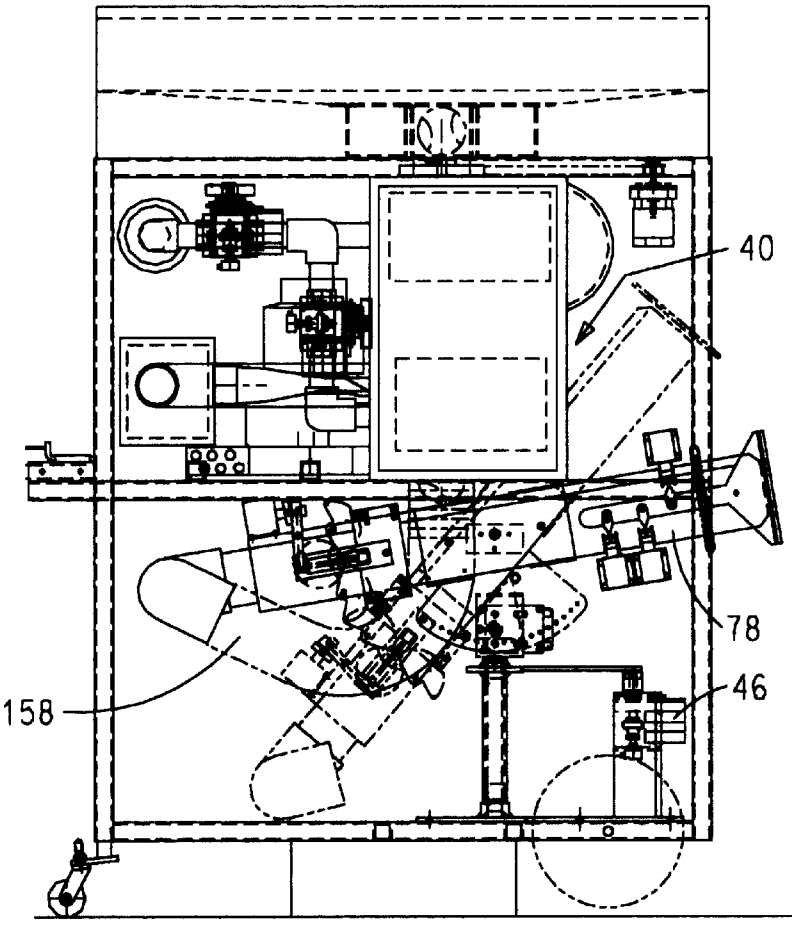
FIG. 12 is a side elevational view of on embodiment of the device of this invention, showing the corresponding locations of the components.
Figure 14:
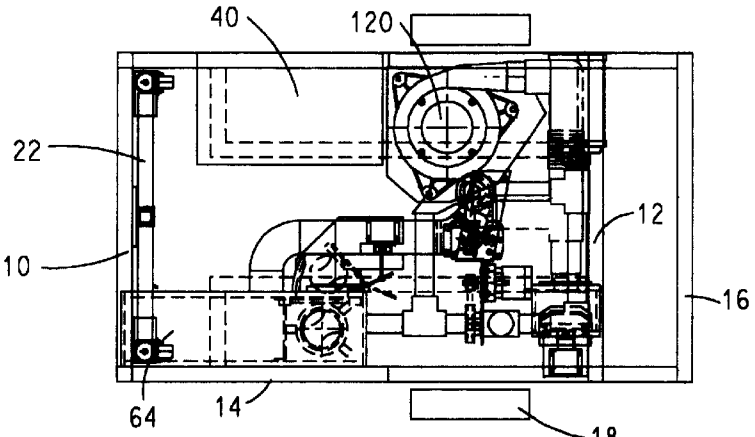
FIG. 14 is a top plan view of the device of this invention.
Figure 15:
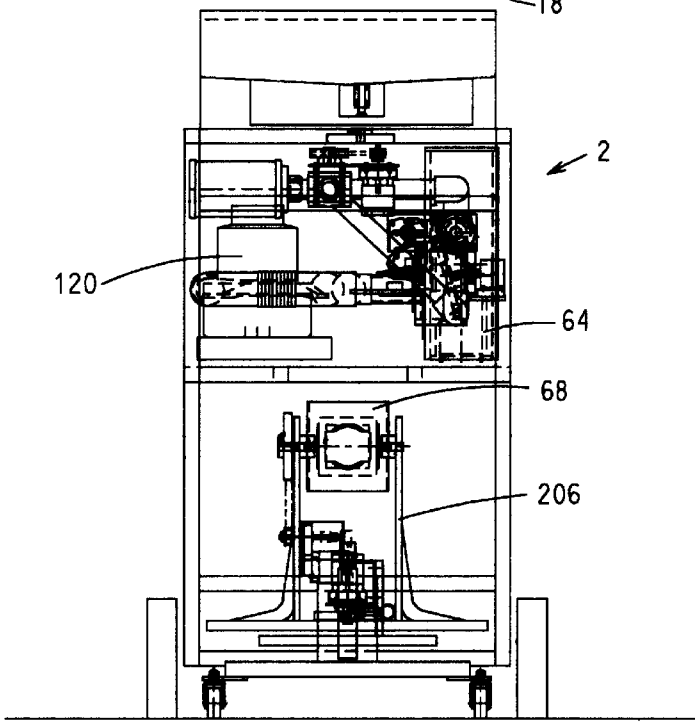
FIG. 15 is a front elevational view of the device of this invention.
Figure 16:
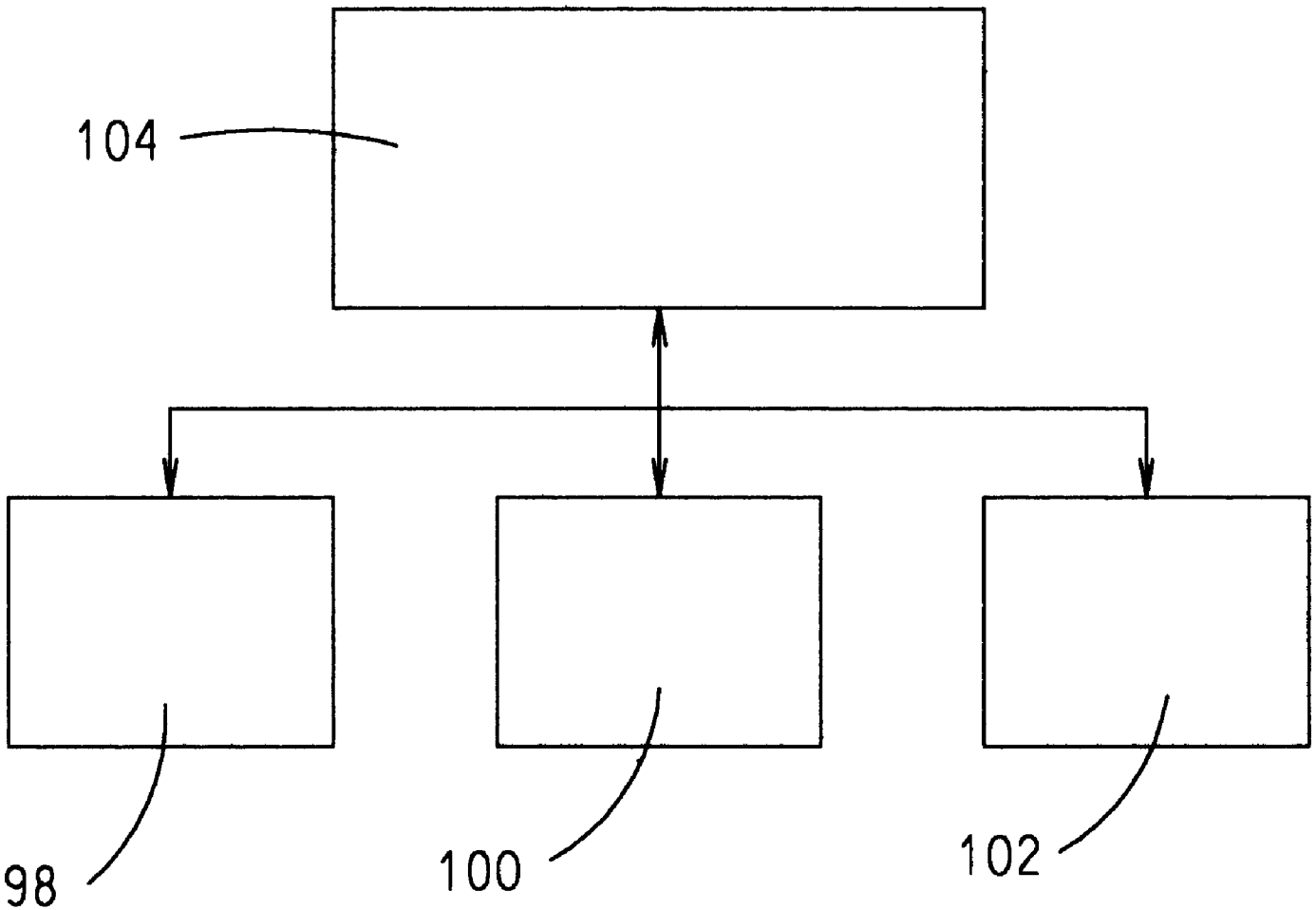
FIG. 16 is a schematic view of the electrical control system for the more complex arrangement of this invention.
Figure 17:
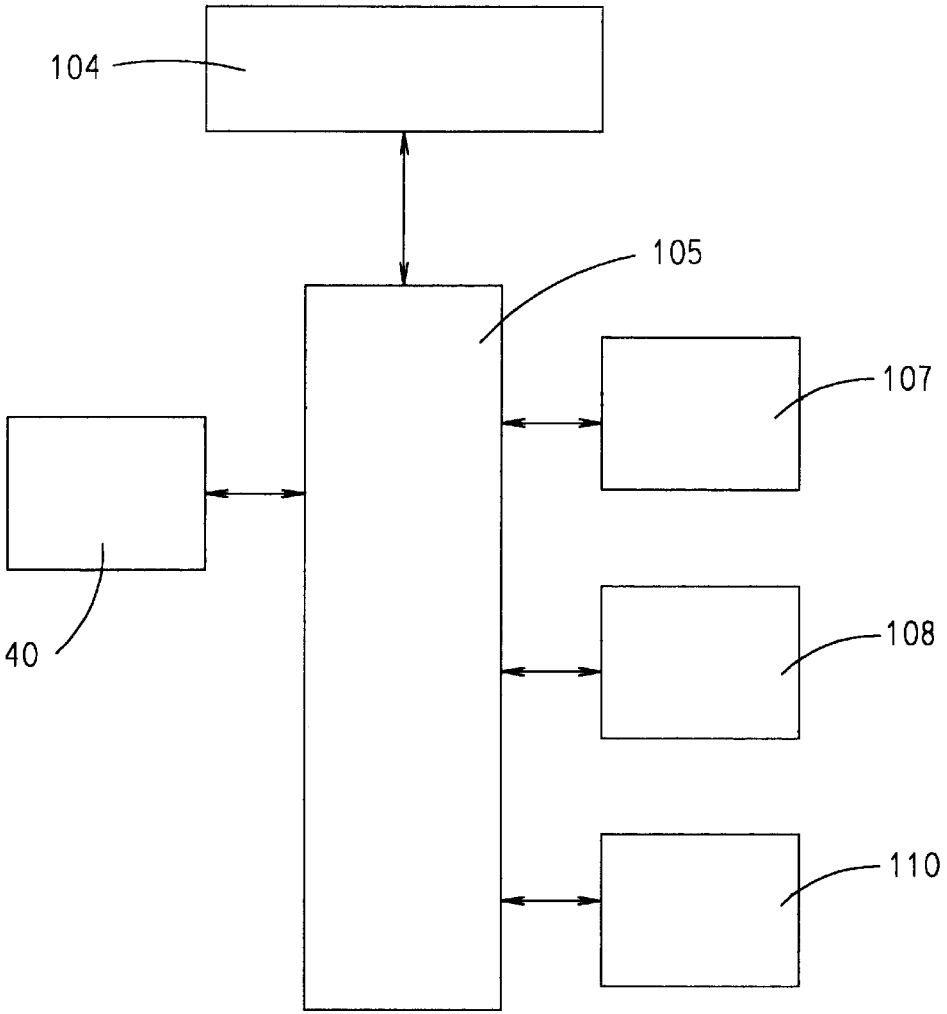
FIG. 17 is a schematic view of the electrical control system for a single machine.
Figure 18:
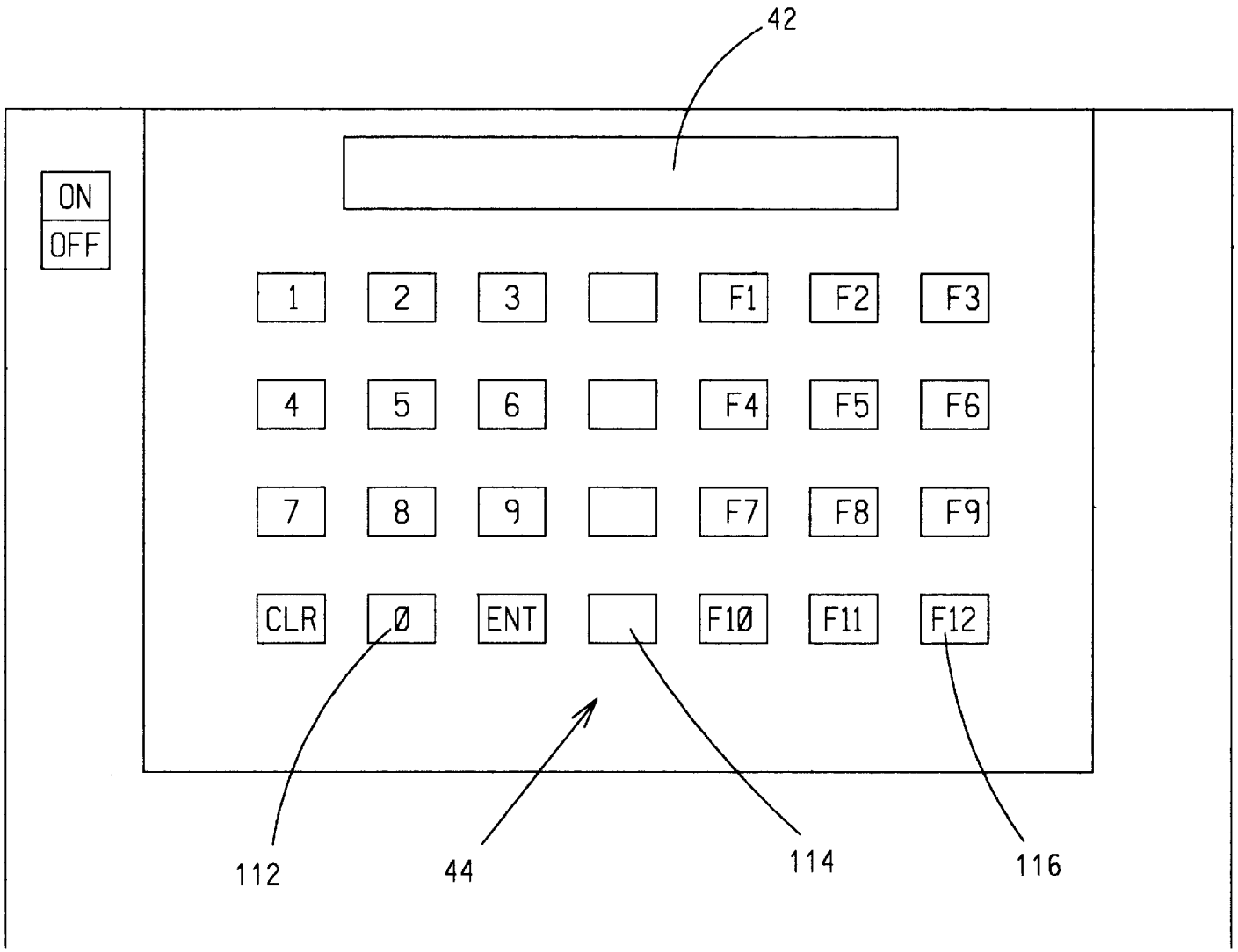
FIG. 18 is an elevational view of the keyboard of the computer of the present invention.

Preferred embodiments of the present invention will now be described with reference to the drawing. Like numbers will refer to like parts throughout the description.

Referring specifically to FIGS. 1–11, the carriage will be described.

The device 2 of this invention comprises a four-wheeled carriage 4 having a top 6, a bottom 8, a front 10, a rear 12, and two side 14 surfaces. A handle 16 is attached to the rear surface 12. In one embodiment, the two rear wheels 18 are large in diameter and the two front wheels 20 or casters are small in diameter. In another embodiment, the two rear wheels 18 are small in diameter and the two front wheels 20 are large. In both embodiments, the small wheels are attached to a crossbar 22. The location of the crossbar 22 is not critical. It is preferred that it be attached to the inner surface 24 of the front wall 10. The crossbar 22 holds a vertical bar 26 having a plurality of adjusting holes 25, one locking in either the up or down position inside a centrally located hollow tube 30 by a locking device 32 such as a spring-loaded pin or bolt. The release of the locking device 32 may be controlled through a cable 34 controlled by a lever 36 on the handle 16. When the two small wheels 20 are extended, the carriage 4 is in its traveling mode. When the two small wheels 20 are retracted, the carriage 4 rests upon a support pad 38 which is fixedly attached to the bottom 8 of the carriage 4. This support pad 38 keeps the weight of the device 2 off of the ground or tennis court, thus avoiding any damage to the environment which is common among similar machines. The support pad 38 is made of any soft, sturdy material, such as rubber or foamed plastic.

Referring now to FIGS. 12–18, an overview of the electrical system will now be described. As the electrical system extends throughout the device 2, specific motors and solenoids will be found in the figures discussing specific systems.

The device 2 of the present invention contains electrical equipment including a microprocessor 40 with display 42 and input means 44, motors 46, 50, 54, 56, and 58 and solenoids 60, 66, 70, 78, 84, and 90. Therefore there is a need for an electrical supply (not shown). A conventional 120V AC electrical supply is adequate for the device 2, which has its own DC output to service its functions. The microprocessor 40 of this device 2 is responsible for initiating and monitoring the various functions of the device 2. It determines the proper sequence of ball deliveries by simultaneously commanding the four separate servos to move to the required position for the next shot and timing the pressurization of the pressure tank 64, firing of the release mechanism 94, and the injection of the next ball 96. The microprocessor 40 may be coupled to a lap-top PC (not shown) with extensive memory capacity, which may include only RAM with both harddrive and floppy disc storage or a combination of RAM/ROM. Permanent memory may be utilized for storage of a large inventory of pre-set programs. The short-term memory of the microprocessor 40 may be used to contain temporary discretionary programs, composed on the spot and entered by the user.

In the more complex arrangement of the devices there is a computer 98 for the left device, a computer 100 for the center device, and a computer 102 for the right device. All of these devices are controlled by a supervisory computer 104.

In any system, each device 2 may have an outside supervisory computer 104. Each device 2 contains a programmable logic control 105 connected to an operator interface 40, a ball load and release system 107, a direction and elevation system 108, and a pressure adjustment system 110.

The microprocessor input mechanism contains numerical keys 112, mode keys 114, and function keys 116 of. The numerical keys are used by the operator to choose the specific shot and shot sequence resired. Each shot embedded in the PLC memory bank has within its code its own combination of psi, placement, timing, and spin. The function keys are used for: Repeat last shot, Repeat last two shots, Repeat last three shots, Repeat last point, etc. There is an LED device 42 for showing the user the identity of the shot being entered and/or the sequence entered.

The device 2 of the present system uses five servos utilizing reversible electric motors 46, 50, 54, 56, and 58 with belt drives. A first motor 46 moves the barrel 48 laterally through an arc of 190 with discrete stops coded through a potentiometer. A second motor 50 moves the barrel 48 in a vertical plane to one of a plurality of preset angular values, coded through a potentiometer and rigidly locked in place by a spring-loaded locking pin 52. A third motor 54 drives a ¾" ball valve to one of several potentiometer-coded positions to provide a pressure range variability. A fourth motor 56, modulated through a pressure differential transducer, drives a ⅜" ball valve to achieve the final pressure called for by the microprocessor 40. A fifth motor 58, modulated by the same pressure sensor, drives a ¼" ball valve to achieve a base pressure calibration from which the microprocessor 40 can more accurately set pressure values. This permits automatic internal compensation for extraneous variable factors such as low voltage access at the compressor motor, etc.

Solenoids 60 are activated by a sensory switch on the carousel so that they function every 180° of carousel travel.

Solenoids 66, 70, 78, 84, and 90 are activated and timed through the software of the microprocessor 40. A plurality, preferably two, solenoids 60 located in the floor of the hopper 62 activate pushers 146 to prevent balls 96 from settling in areas of little ball mobility. A plurality, preferably three, solenoids 66 are used to modulate the type and degree of spin by controlling the spin plate 68. Another solenoid 70 controls the horizontal injection of a ball 96 by means of a rotating sweep arm 72 through a pressure flap door 74 into the pressure tank 64 and guide channel 76. Another solenoid 78 operates to close the by-pass valve 80 in the pneumatic system 82. Still another solenoid 84 controls the simultaneous release of the four ball impeders 86 through the forward motion of a sliding locking sleeve 88, thus initiating the firing of a ball 96. Another solenoid 90 retracts the locking pin 52 of the barrel elevation mechanism 92 to permit vertical movement of the barrel 48 and protracts the locking pin 52 of the barrel elevation mechanism 92 to stabilize to barrel elevation mechanism 92.

Referring to FIGS. 19–31, the pneumatic system 82 will now be described.

Many conventional tennis ball propulsion devices employ spinning wheels to propel the tennis balls. For reasons spelled out earlier, this method has been shown to be unacceptable for purposes of generating realistic game conditions. The inventor has discovered that the use of pneumatic propulsion obviates the problems inherent in the spinning wheel method.

To meet stringent limits for accuracy and consistency, pneumatic projection of the ball 96 is employed with regulation of air pressure behind any given ball 96 controlled to a demanding precision. In contrast with machines that provide spinning wheel projection, this provides a high level of consistency of ball 96 performance in spite of a wide range of difference in the physical condition of the balls 96 used in terms of surface wear, compressibility, etc.

Figure 19:
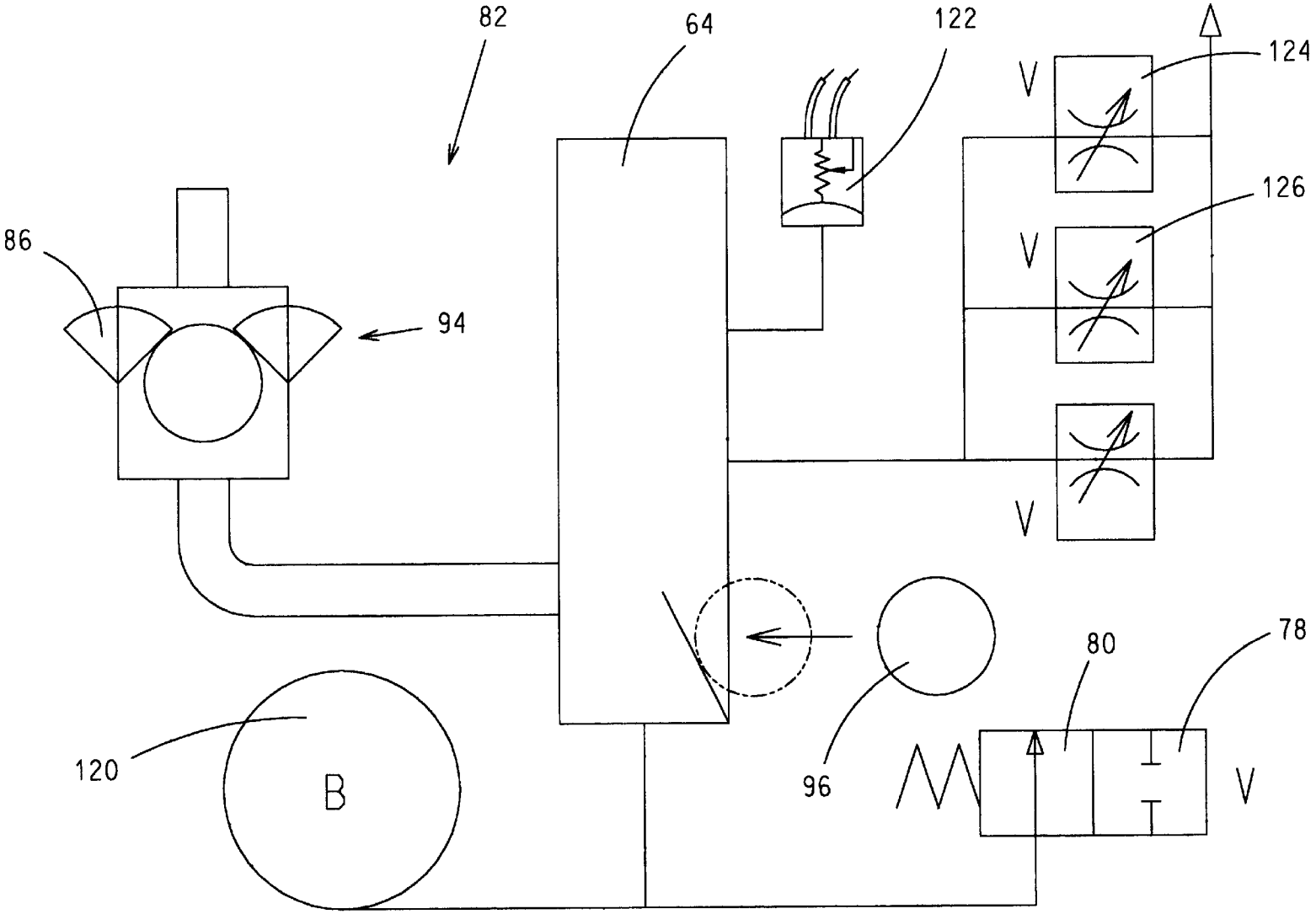
FIG. 19 is a schematic view of the air control system of the device of this invention.
Figures 20, 21, 22:
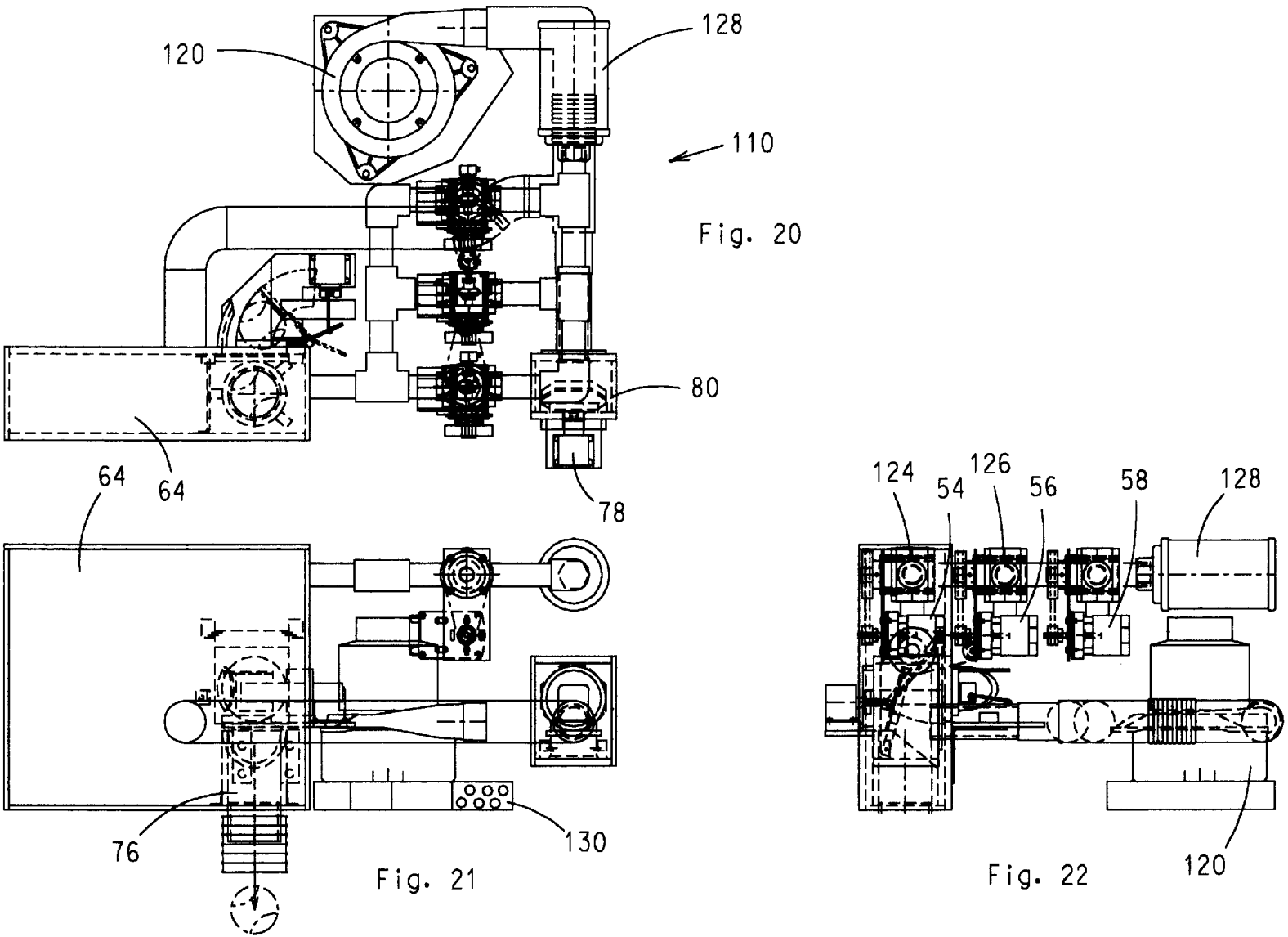
FIG. 20 is a top elevational view of the air control system of the device of this invention.
FIG. 21 is a side elevational view of the air control system of the device of this invention.
FIG. 22 is a rear elevational view of a portion of the air control system of this invention showing the control valves.
Figure 23:
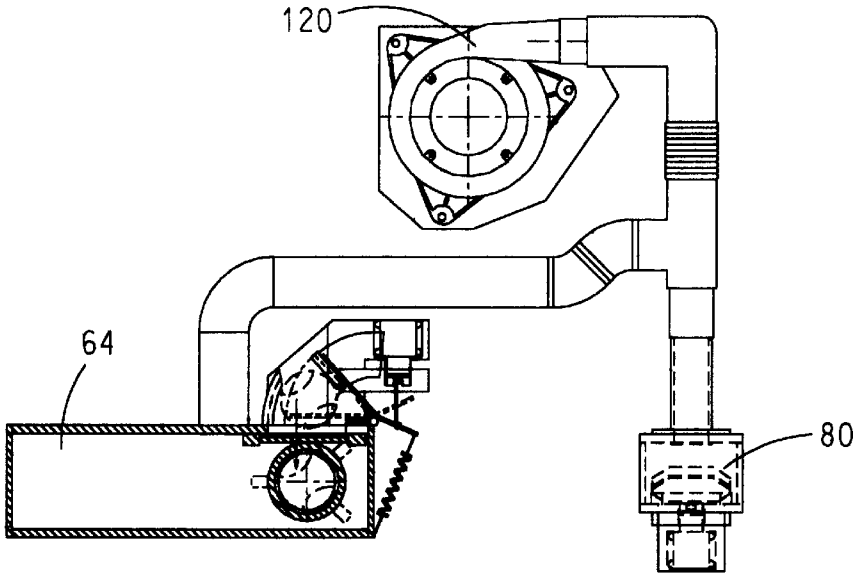
FIG. 23 is a top elevational view of a portion of the air control system of this invention showing the connection between the blower, pressure tank, and by-pass valve.
Figure 25:
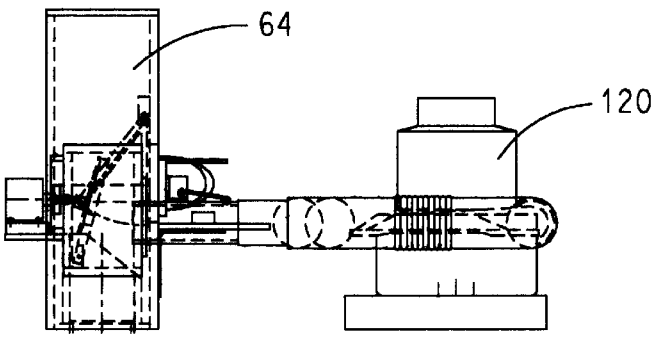
FIG. 25 is a rear elevational view of a portion of the air control system of the present invention.
Figure 24:
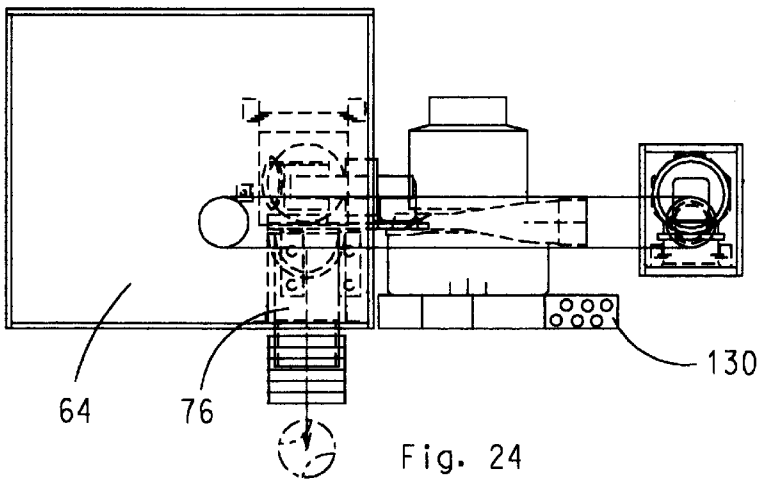
FIG. 24 is a side elevational view of the air control system of the present invention.
Figure 26:
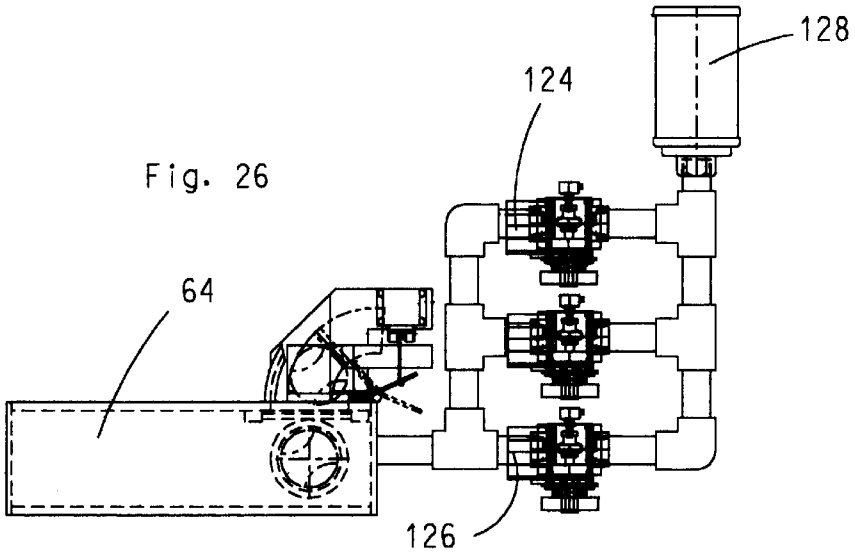
FIG. 26 is a top elevational view of the pressure control valves of this invention.
Figure 28:
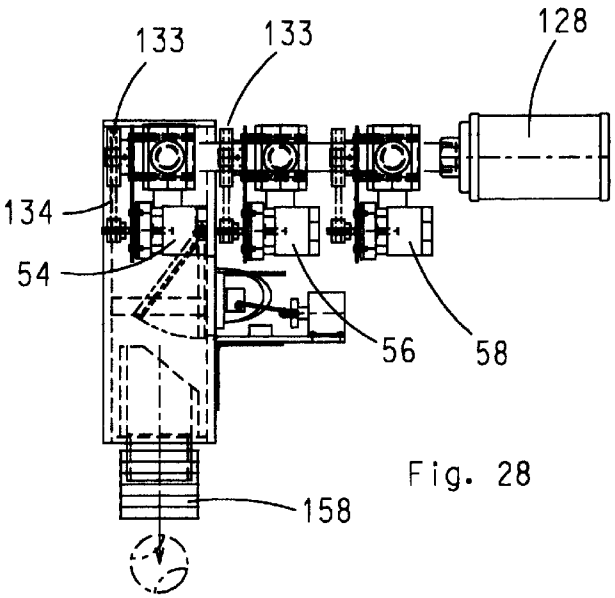
FIG. 28 is rear elevational view of another portion of the air control system of this invention.
Figure 27:
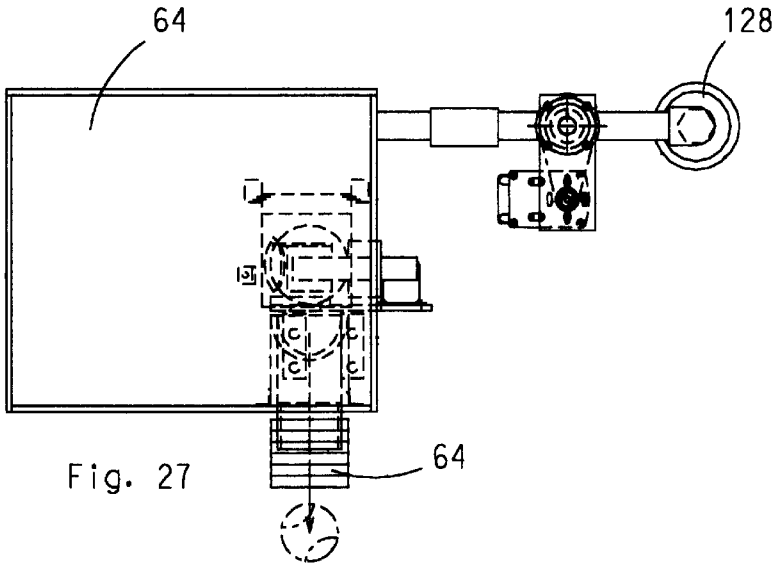
FIG. 27 is a side elevational view of a portion of the air control system of this invention.
Figure 29:
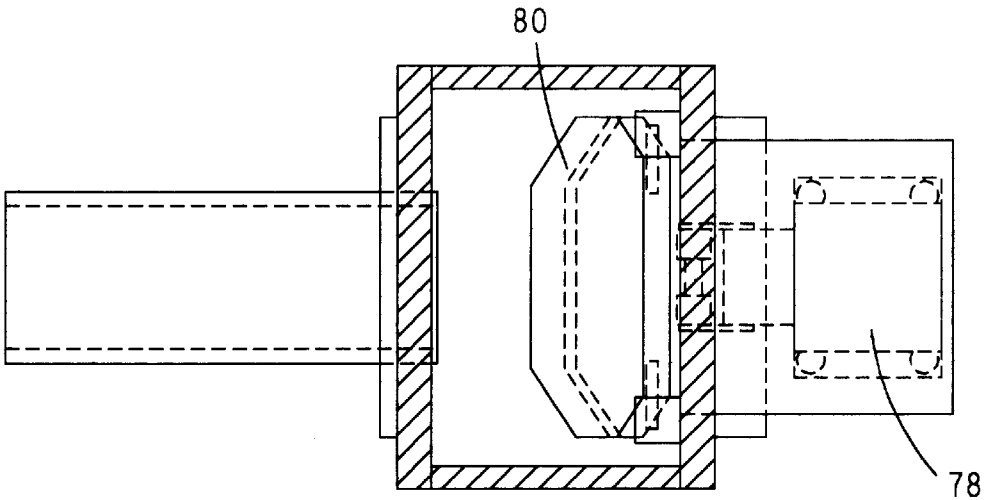
FIG. 29 is a top view of the by-pass valve
Figure 30:
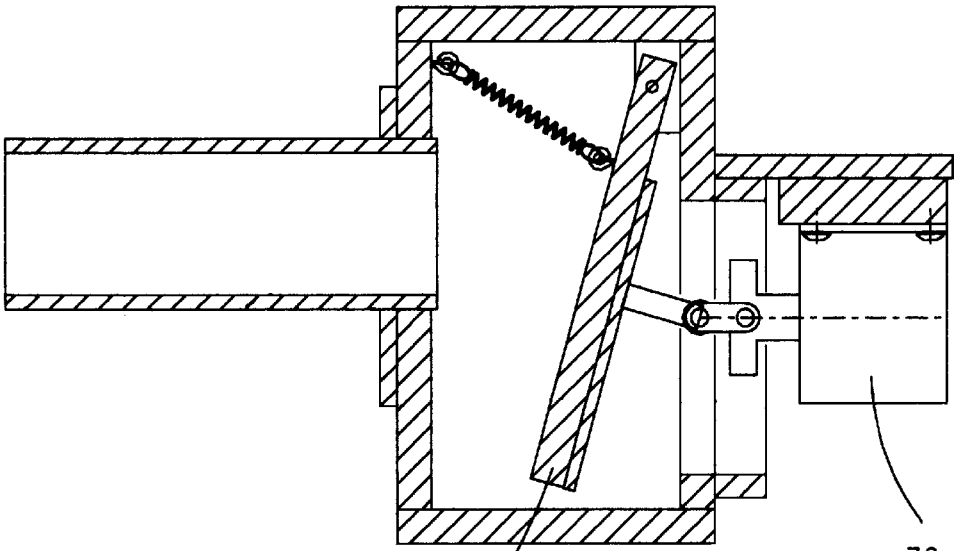
FIG. 30 is a rear cross-sectional view of the by-pass valve.
Figure 31:
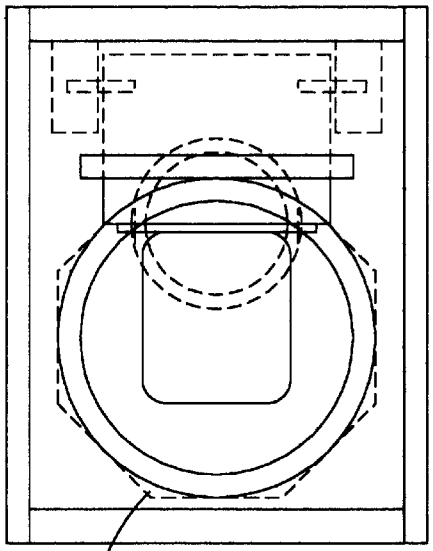
FIG. 31 is side view of the by-pass valve in the closed position.
Figure 35:
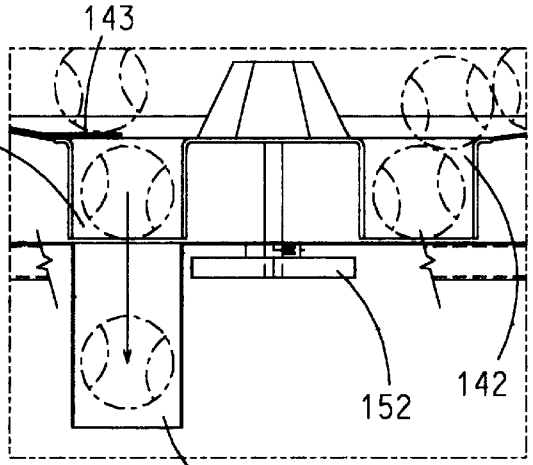
FIG. 35 is a magnified view of FIG. 34, showing the outlet cover in detail.
Figure 34:
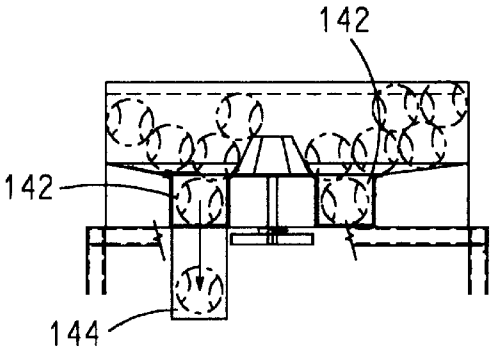
FIG. 34 is a rear view of the ball-feeding mechanism showing balls in position.
Figure 36:
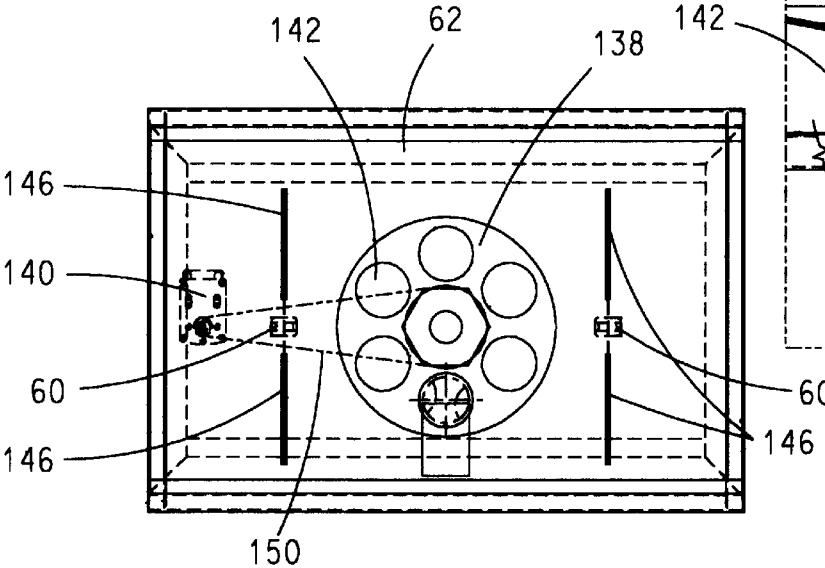
FIG. 36 is a top plan view of the ball-feeding mechanism.
Figure 33:
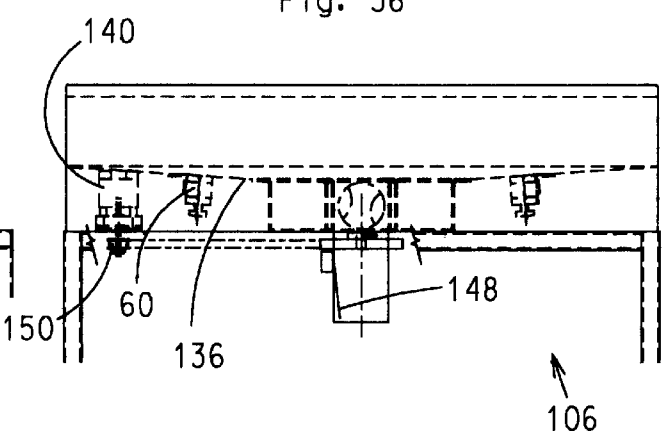
FIG. 33 is a side elevational view of the ball-feeding mechanism of this invention, partly in section to show a ball in the ball feed point and the ball sensing switch.
Figure 32:
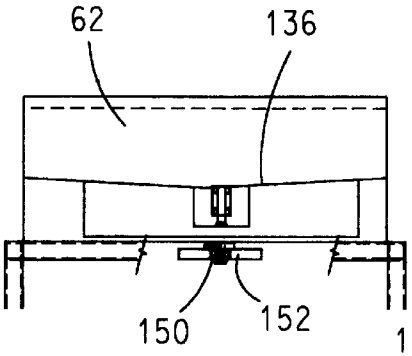
FIG. 32 is a front elevational view of the ball-feeding hopper, partly in section to show detail.
Figures 37, 38, 39:
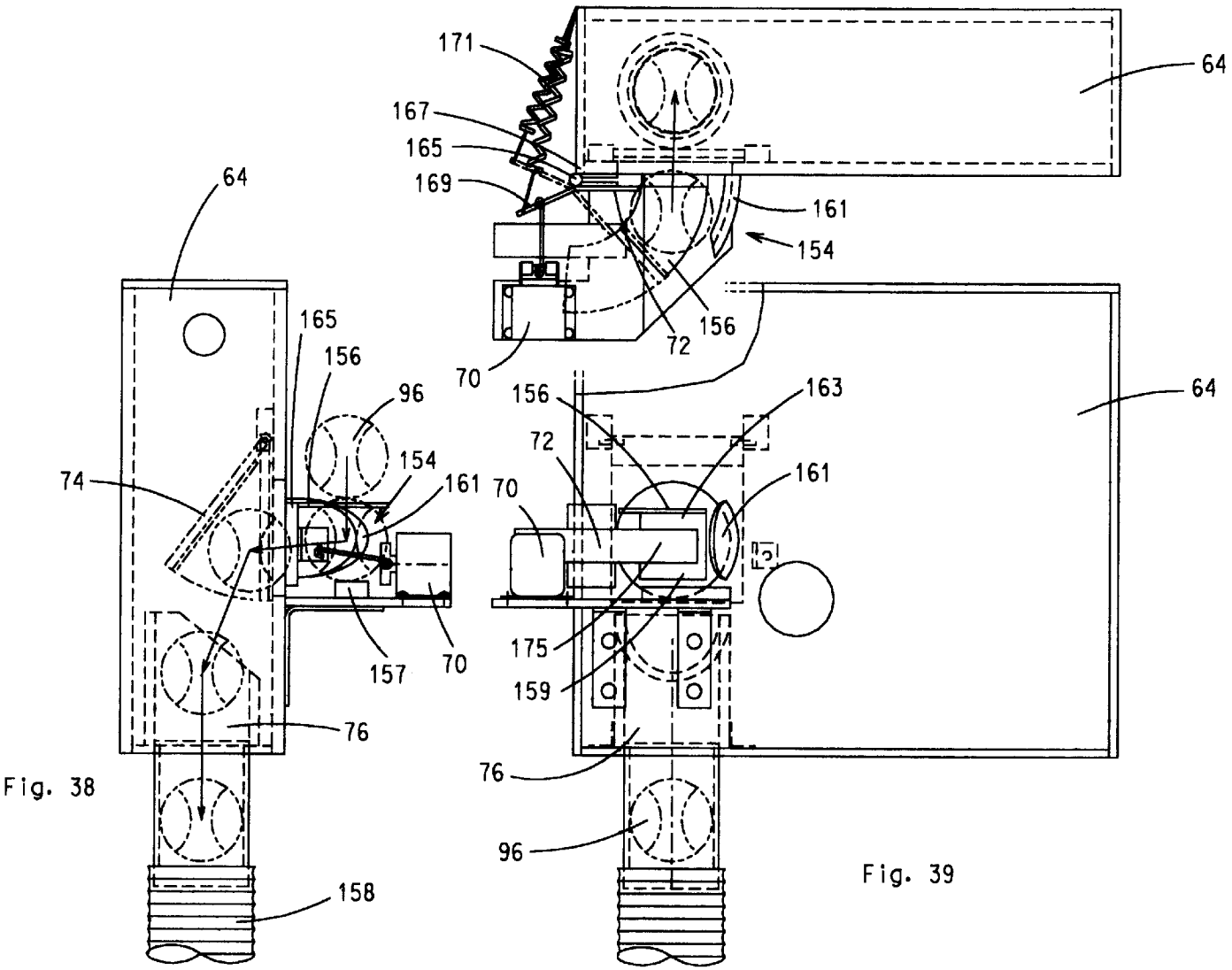
FIG. 37 is a top sectional view of the pressure tank and injector mechanisms
FIG. 38 is a rear elevational view of the injector mechanism of this invention.
FIG. 39 is a side elevational view of the pressure tank and injector mechanisms.
Figure 40:
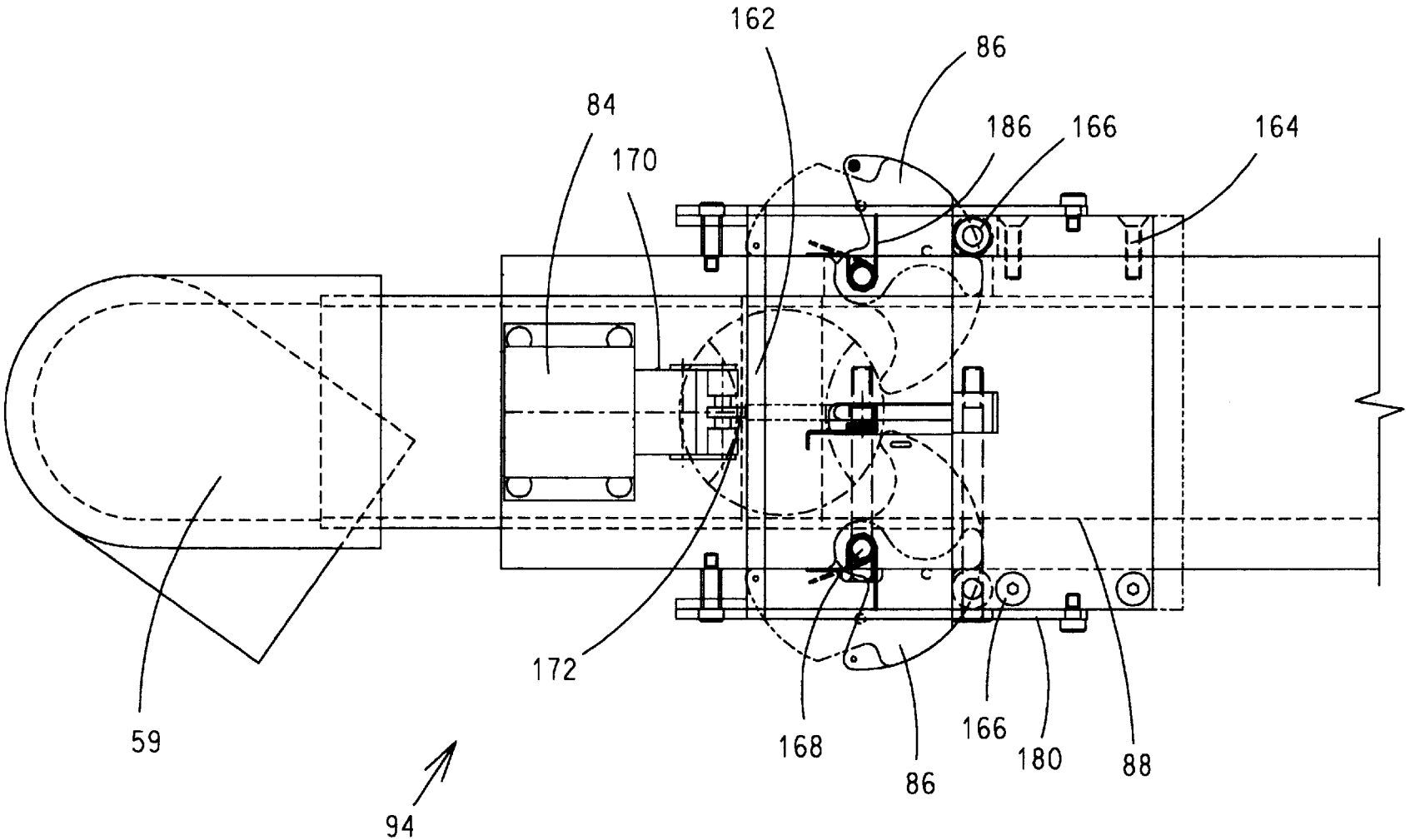
FIG. 40 is a side view of the proximal portion of the barrel showing the impeders.
Figure 41:
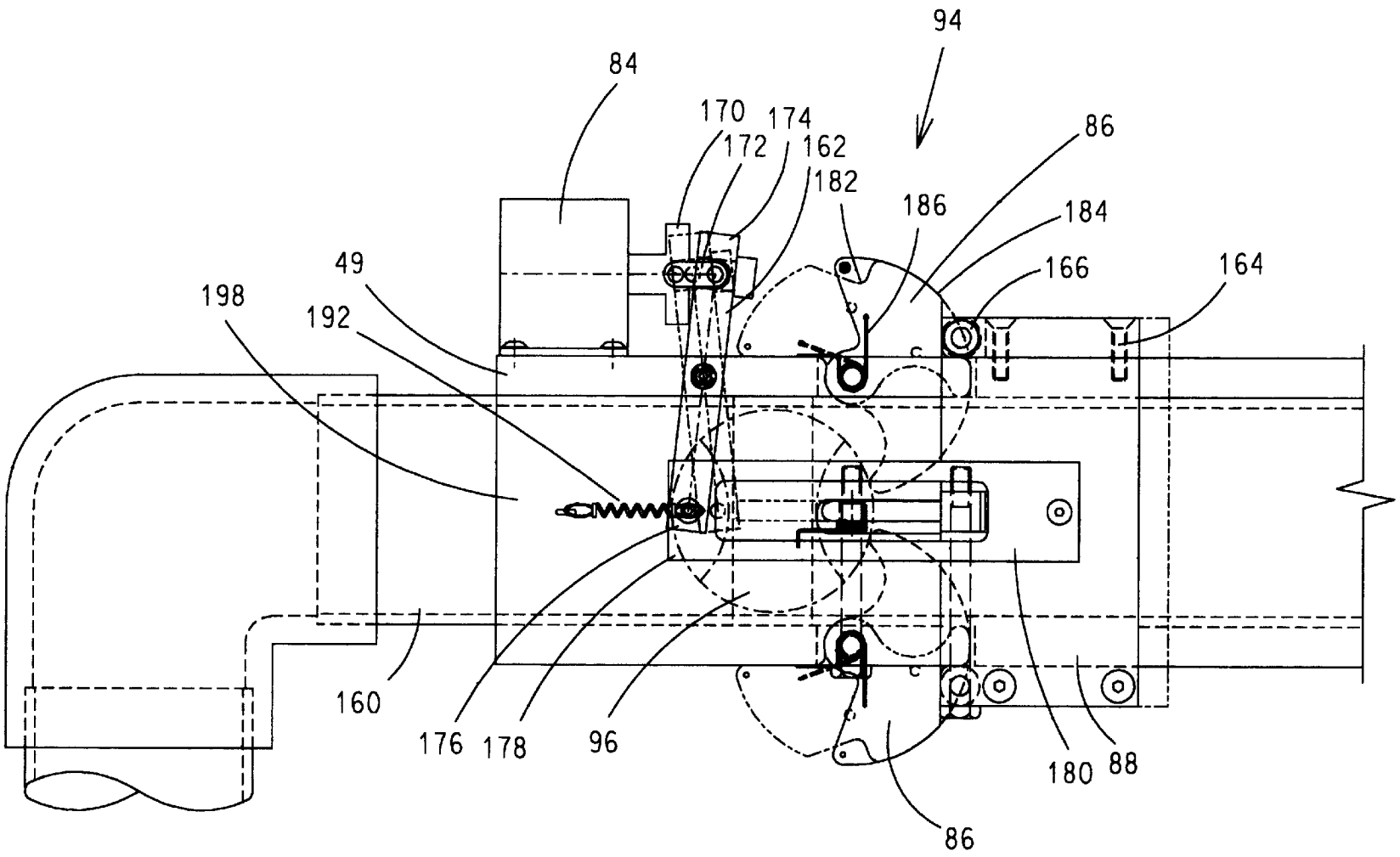
FIG. 41 is a bottom view of the proximal portion of the barrel showing the impeders.
Figures 42, 43, 44, 45, 46, 47:
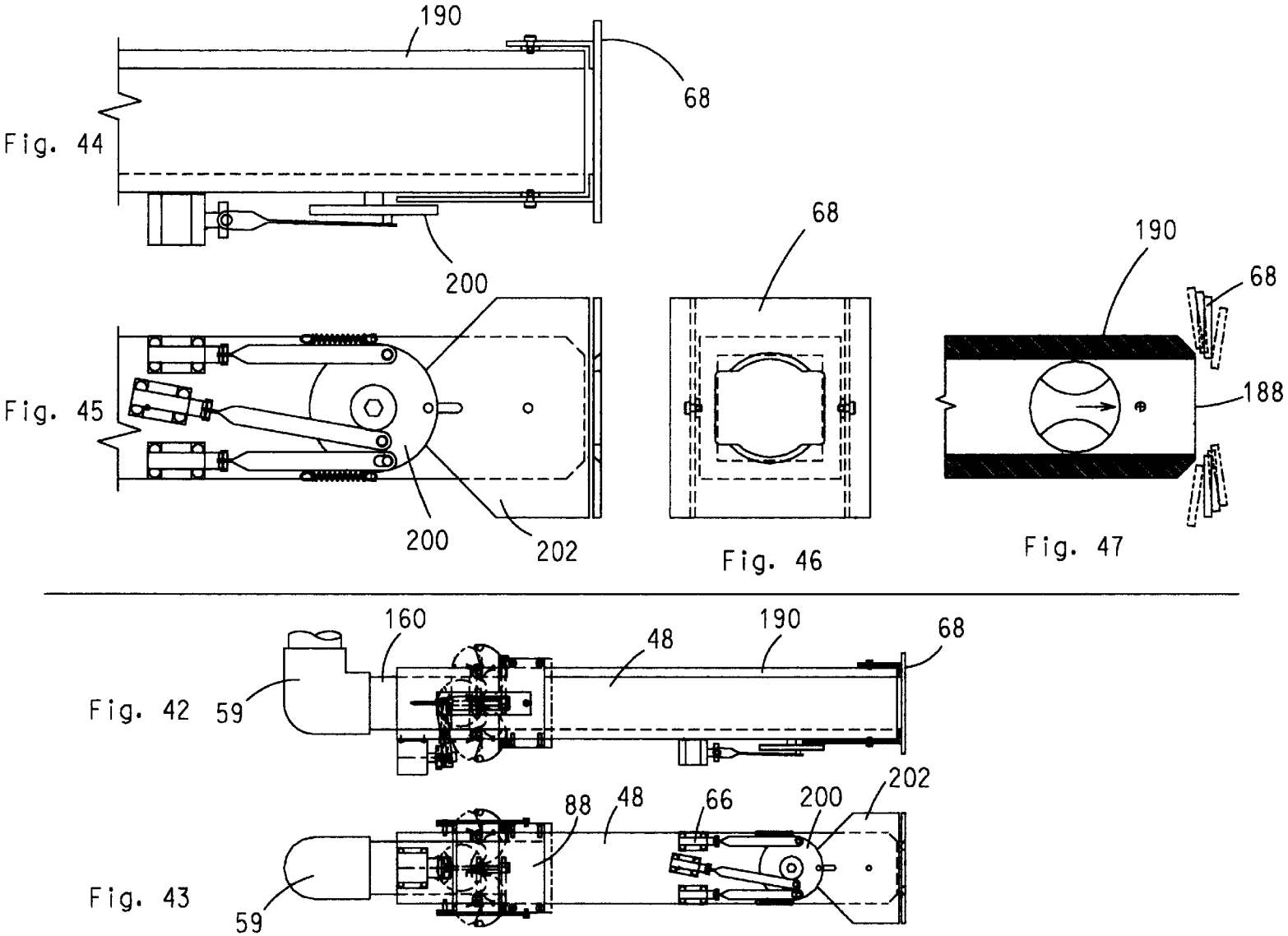
FIG. 42 is a top elevational view of the barrel.
FIG. 43 is a side elevational view of the barrel.
FIG. 44 is a top elevational view of the distal portion of the barrel.
FIG. 45 is a side elevational view of the distal portion of the barrel.
FIG. 46 is a front elevational view of the spin plate which imparts spin to a propelled ball.
FIG. 47 is a side sectional view of a ball in the distal portion of the barrel. Various positions of the spin plate are shown.
Figure 48:
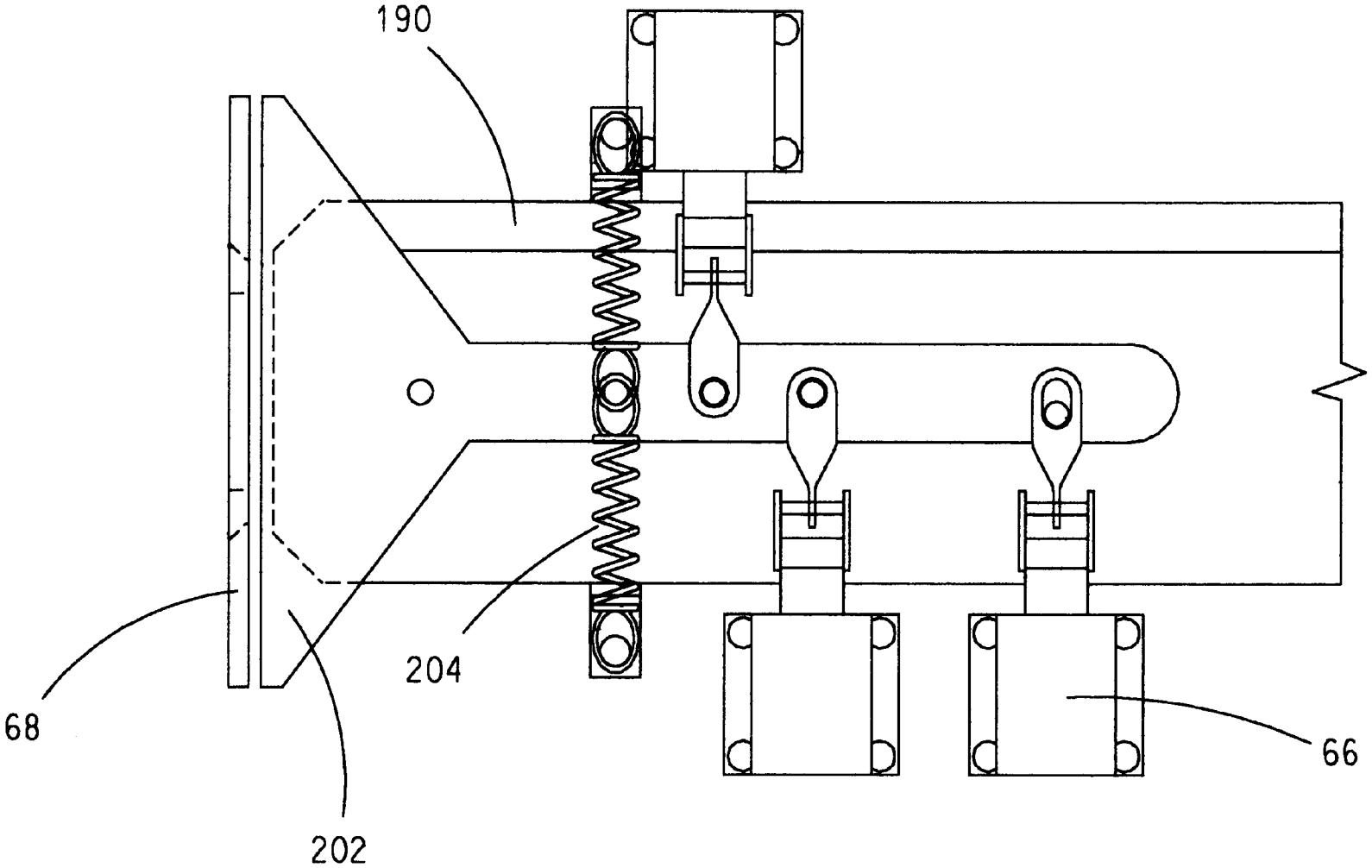
FIG. 48 is a side elevational view showing a second embodiment of the spin actuating solenoids.
Figures 49, 50, 51:
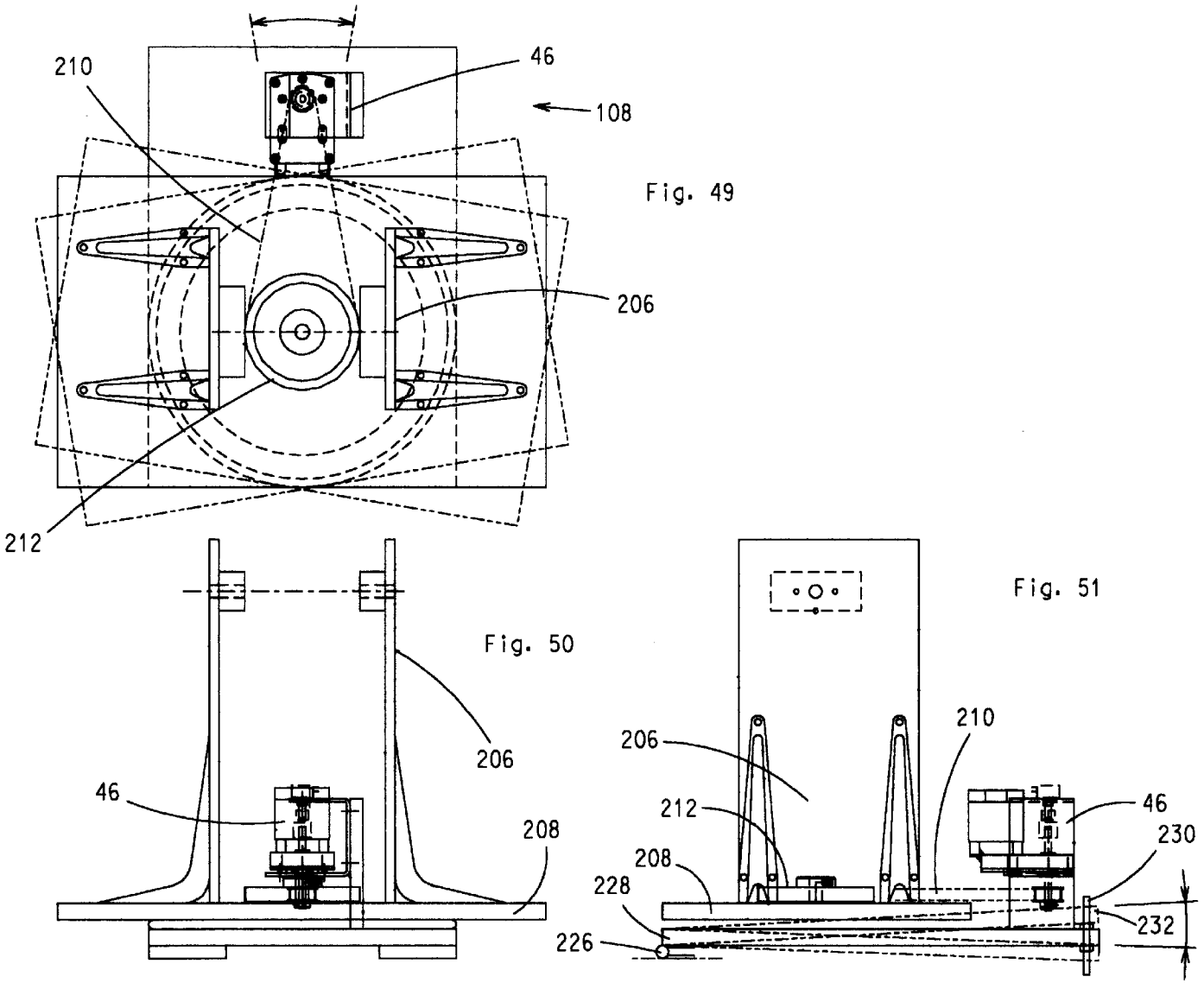
FIG.49 is a top plan view showing the lateral aiming mechanism.
FIG. 50 is a front elevational view of the holder for the barrel showing the lateral aiming mechanism.
FIG. 51 is a side elevational view of the holder for the barrel showing the lateral aiming mechanism.
Figure 52:
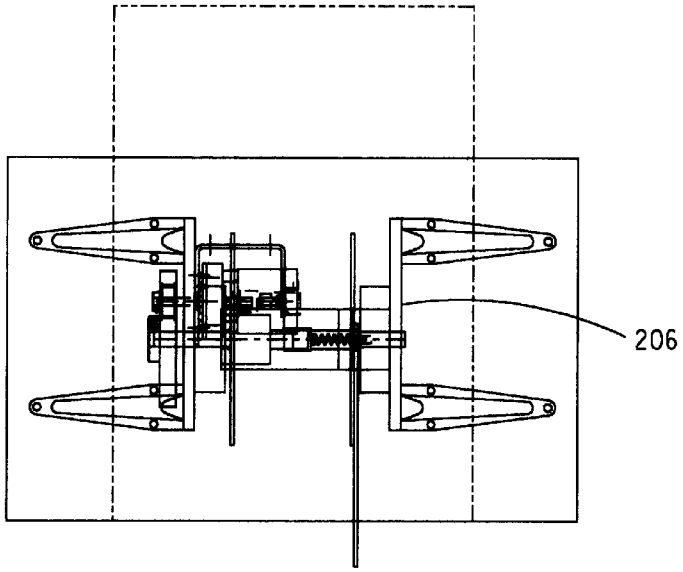
FIG. 52 is a top elevational view of the holder for the barrel showing the drive motor for the vertical aiming mechanism.
Figure 53:
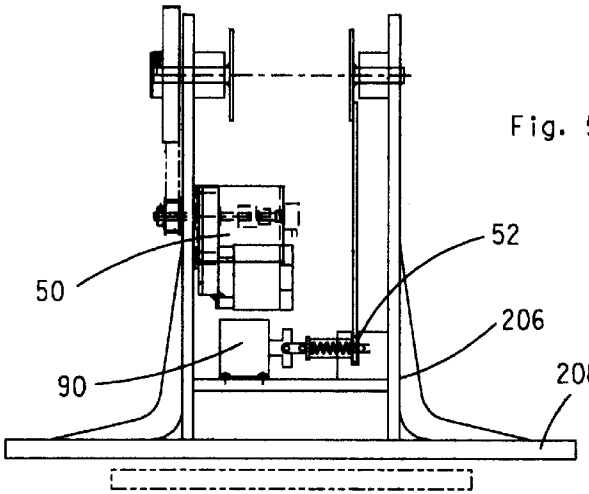
FIG. 53 is a front elevational view of the holder for the barrel showing the drive motor for the vertical aiming mechanism.
Figure 54:
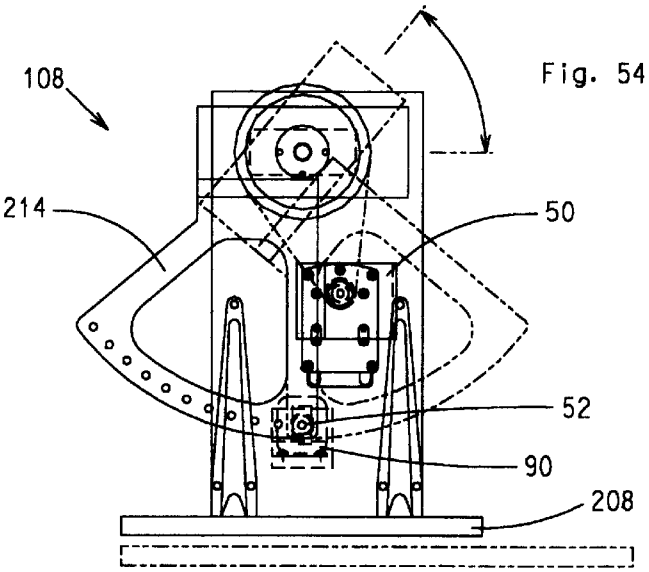
FIG. 54 is a side elevational view of the holder of the barrel showing the vertical aiming and locking mechanism.
Figure 55:
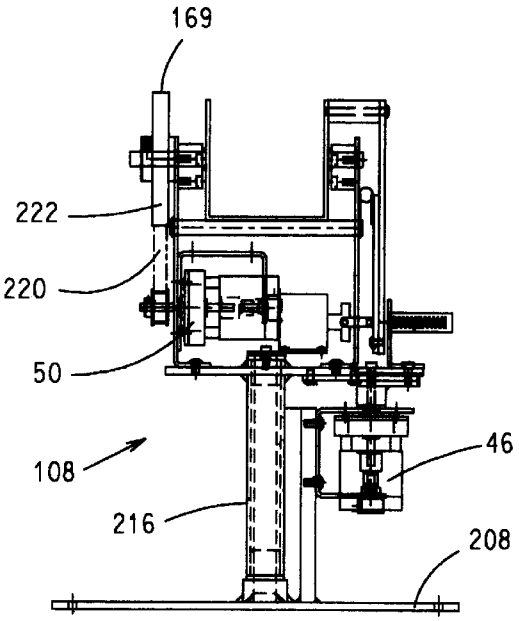
FIG. 55 is a front elevational view of another embodiment of the holder for the barrel and the lateral and vertical aiming mechanism.
Figure 56:
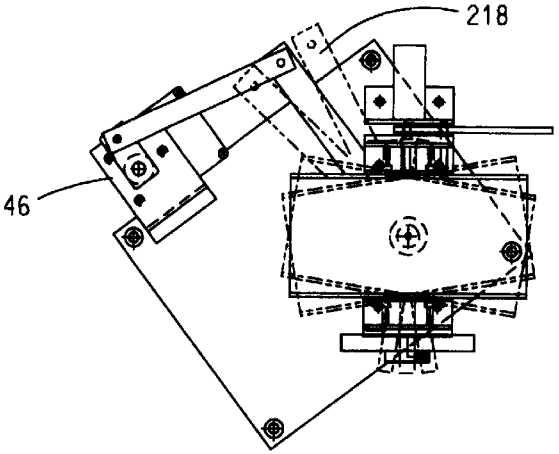
FIG. 56 is a top plan view of the embodiment shown in FIG. 55 showing the lateral aiming mechanism.
Figure 57:
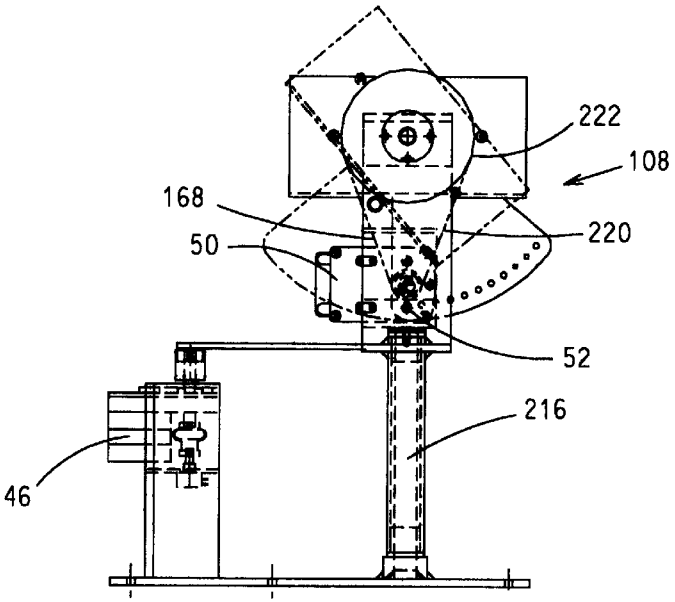
FIG. 57 is a side elevational view of the embodiment shown in FIG. 55 showing the vertical aiming mechanism.

A schematic view of the pneumatic system 82 used in the present invention is disclosed in FIG. 19. In brief, this system 82 is powered by the blower component 120 of a vacuum machine which is connected to a solenoid-controlled by-pass valve 80. The compressed air enters a pressure tank 64. A pressure sensor 122 takes an accurate reading of the pressure inside the pressure tank 64. This pressure is adjusted by the use of a series of course 124 and fine 126 pressure control valves connected to an exhaust muffler 128. The air is pressurized in the pressure tank 64 and is held behind a tennis ball 96 which is held back by four impeders 86 (shown in FIGS. 40 and 41) at the desired air pressure until the exact time for the ball 96 to be released. The impeders 86 are released simultaneously, allowing the accumulated air pressure to propel the ball 96 forward out of the barrel 48.

In more detail, an intake filter housing 130 allows intake of air into the blower 120 (vacuum motor). A vacuum motor functions by being under load when incoming vacuum suction is high and the outgoing pressure is low and by coasting when the pressure side is partially or totally blocked. When the latter occurs and the motor is not under load, the brushes of the motor tend to lose carbon deposition, resulting eventually in a degradation of motor performance. Consequently, in order to avoid this degradation it is imperative, when using the pressure potential of a vacuum motor, to limit to the minimum the time of pressurization. To address this problem, a large by-pass valve 80 is inserted in the pressure line system so that free air flow is present at all times except when the valve 80 is closed to divert the air into the pressure tank 64 and lines for the shortest possible interval just before firing.

Air coming out of the blower 120 is directed to the pressure tank 64 wherein adequate pressure is established. The build-up of pressure in the pressure tank 64 is controlled by the setting of the by-pass valve 80. When this valve 80 is open, air from the blower 120 escapes to the outside and no additional pressure is built up in the pressure tank 64. When this valve 80 is closed, no air escapes to the outside and pressure is built up in the pressure tank 64.

Air under pressure leaves the pressure tank 64 and passes through a series of pressure control valves. The purpose of these control valves is to ensure the exact pressure desired in the pressure tank 64. This is accomplished by use of a ¾" pipe ball valve coupled with a pulley 133 and belt 134 drive system driven by a reversible brake motor 54 slaved to a potentiometer with preset values for discrete pressure ranges. Also, a reversible motor 56 slaved to a pressure differential sensor drives a ⅜" pipe ball valve. An additional motor 58 drives a ¼" ball valve to achieve a base pressure calibration from which the microprocessor 40 can more accurately set pressure values. This permits automatic internal compensation for extraneous variable factors such as low voltage access at the blower 120. The microprocessor 40 commands the positioning of the servo to the preset pressure desired. The discrete positions for the larger of the two pneumatic ball valves are attained by a potentiometer with preset values, while those of the smaller are acquired through readings from a differential pressure sensor acting on the drive motor 58.

Referring to FIGS. 32 to 39, the control of the tennis balls 96 prior to entry into the air stream will be discussed.

The ball hopper 62 of this invention is substantially the same as that of conventional devices, in that it holds about 300 balls and has the bottom surface 136 slanted from all sides to the middle to induce the balls 96 to migrate by gravity to a multiple chamber carousel 138 driven by a small electric motor 140. Differences between conventional hoppers and the hopper 62 of this invention exist in that whereas hoppers of the prior art use a rotating carousel with four to six ball slots for timed injection, the carousel 138 of the present invention contains four to six ball capturing sockets 142 and rotates only when a vacancy occurs in the outlet tube 144. In hoppers of the prior art, balls tend to gather in a location where there is little movement of the balls. This situation is avoided in the present invention as timed solenoids 60 located on the bottom wall 136 of the hopper 62 advance and retract pushers 146 to keep the balls 96 from settling in an area of little movement. The ball capturing socket 142 directly over the ball outlet tube 144 is protected by a socket cover 143 to prevent balls 96 from jamming the ball 96 in this socket.

Upon entering the ball outlet tube 144, the ball 96 pushes against a ball sensing switch arm 148 to open an electrical circuit to the carousel 138. An open circuit triggers the drive feed motor 140 to stop running, thus stopping the carousel 138 and preventing the feeding of another ball 96. When a ball 96 proceeds past the switch arm 148 and the circuit is closed, the drive feeder motor 140 of the hopper 62 is triggered to turn thereby turning a drive belt 150 attached to a drive wheel 152 directly under the center of the carousel 138 to cause the multiple pocket carousel 138 feeder to advance one unit to bring another ball 96 in position above the ball outlet tube 144. The ball 96 passes by gravity into a solenoid-activated injection area 154.

When a ball 96 is in the injection area 154, it rests on the floor 157 of the injection area 154, just in front of the injector 159, which is a plate capable pushing the ball 96 through the pressure flap door 74 into the pressure tank 64; just beside a curved guide 161, and just under a following ball. Extending from the top edge 163 of the injector 159 is a blocking plate 156 which keeps balls 96 above the blocking plate 156 from entering the injection area 154 when the ball 96 in the injection area 154 is being pushed through the pressure flap door 74. The injector 159 and blocking plate 156 are controlled by a sweep arm 72. The sweep arm 72 is pivoted around a pivot post 165 at the corner 167 of the pressure tank 64. The first end 169 of the sweep arm 72 attaches to a coil spring 171 which tends to hold the sweep arm 72 in a position away from the pressure tank 64. The sweep arm 72 is also connected to a solenoid 70 which, when activated, pulls the sweep arm 72 so that it pivots around the pivot post 165 causing the injector 159 attached to the second end 175 of the sweep arm 72 to push a ball 96 past the pressure flap door 74. The second end 175 of the sweep arm 72 is attached to the blocking plate 156. When a ball 96 is being pushed by the injector 159 from the injection area 154 through the pressure flap door 74, the blocking plate 156 prevents the ball 96 which is behind the ball 96 in the injection area 154 from entering into the injection area 154. After the ball 96 is pushed through the pressure flap door 74, the coil spring 171 pulls the sweep arm 72 away from the pressure flap door 74, making room for the next ball 96 to enter the injection area 154.

Each ball 96 is horizontally delivered one at a time from the injection area 154 into the pressure tank 64 by means of a solenoid-activated rotating sweep arm 72 through a flap door 74 directly into a guide channel 76 leading through the pressure tank 64 to a flexible tube 158 and into the barrel 48. This permits the entrance of only one ball 96 at a time into the pneumatic system 82. Following entrance of the ball 96 into the guide channel 76, the flap door 74 returns to the closed position allowing for the desired regulation of pressure in the pressure tank 64.

The propulsion of the ball 96 by air pressure will be discussed with reference to FIGS. 40–48.

After closure of the flap door 74 the ball 96 is propelled by air pressure through the guide channel 76, through a flexible tube 158, and into the constricting throat in the proximal portion of the barrel 48. In the barrel 48, the ball 96 is the same size as the internal dimensions of a tube 160 extending from the inlet tube 59 to the opening 188 in the distal end 190 of the barrel 48, and the presence of the ball 96 ahead of the air supply keeps air from escaping from the pneumatic system 82. The air pressure forces the ball 96 to push against four impeders 86 equally spaced around the barrel 48. The ball 96 is locked in place behind the impeders 86 allowing for a choice of any range of pressure to be behind the ball 96 at the moment of release. The release of the impeders 86, and hence the ball 96, is activated electronically by means of a solenoid 84 operating through a yoke 162 and release mechanism 94 composed of a sliding locking sleeve 88 with holddown bolts 164 with rollers 166, and this release is achieved through an internal timer within the microprocessor 40 acting on command of the computer program. The release of the impeders 86 can be timed to within a hundredth-of-a-second accuracy by a timing command from the software in the microprocessor 40.

Preferably there are four impeders 86 equally spaced around the barrel 48. Each impeder 86 pivots around an axle 168 positioned in the barrel wall 49 and is normally held by a spring 186 in a vertical position to impede the progress of the ball 96 when locked in place by a roller 166 on the sliding locking sleeve 88. The single solenoid 84 responsible for the release of the impeders 86 is preferably attached to the side of the barrel 48 which is opposite the juncture of the inlet tube 59 and the proximal end of the barrel 48. The stem 170 of the solenoid 84 is attached through a linking means 172 to the first end 174 of a yoke 162 which is pivotally attached to the release mechanism 94. The second end 176 of the yoke 162 is pivotally attached to the proximal end 178 of the release rod 180. Thus, as the solenoid stem 170 moves distally and proximally, the release rod 180 moves proximally and distally, respectively. The release rod 180 is attached to, and controls the position of, the sliding locking sleeve 88. When a ball 96 is held by the impeders 86, a notch 182 on the outer surface 184 of each of the impeders 86 engages a roller 166 carried by the sliding locking sleeve 88. When the solenoid 84 is activated, the solenoid stem 170 is moved proximally, the release rod 180 is moved distally, moving the sliding locking sleeve 88 distally and disengaging the roller 166 from the impeder 86 surface. When the impeder 86 is freed, the pressure behind the ball 96 causes the ball 96 to press against and rotate the impeder 86 so that it no longer impedes the ball 96 and the ball 96 is propelled through the opening 188 at the distal end 190 of the barrel 48 by the force of air. Ball 96 release is instantaneous and does not suffer a delay by waiting for subsequent capture of the ball 96 by spinning wheels or the build-up of pneumatic pressure to the required level for overcoming the restraint of a bladder or other obstruction.

A coil spring 192 is attached at one end to the proximal end 198 of the release mechanism 94 and at the other end to the proximal end 178 of the release rod 180. When the release rod 180 is moved distally during the ball 96 release operation, tension is applied to the coil spring 192. Following the release of the ball 96, the impeders 86 are returned to their normal vertical locking position by springs 186 and the coil spring 192 forces the release rod 180 proximally, thereby moving the sliding locking sleeve 188 and the attached rollers 166 proximally back over the surfaces of the impeders 86 to lock them in place for stopping the next ball 96.

Spin may be imparted to the ball 96 by adjustment of the spin plate 68 by solenoids 66 which are connected to an adjustment wheel 200 capable of raising, lowering, and tilting the spin plate 68. Both top-spin and back-spin are produced by the relevant portion of the spin plate 68 secured to the side of the spin plate holder 202 pivotally mounted on the distal end 190 of the barrel 48. The position of the plate 68 is governed by the activation of at least one of three solenoids 66 or the plate 68 may be in a spring 204-loaded neutral position for no spin.

With reference to FIGS. 49–57, the lateral and vertical aiming of the ball 96 will now be described.

In one embodiment, the barrel 48 is held between two support plates 206 so that it may rotate in a vertical direction. The support plates 206 are connected to a rotatable support base 208. The lateral drive motor 46 turns the rotatable support base 208 by a belt 210 to a pulley 212. The barrel 48 is capable of a 19° range of lateral scope. The barrel 48 is connected to a vertical position adjuster 214 which is moved in response to the vertical drive motor 50. The barrel 48 is capable of a 50° range of vertical scope. From a theoretically infinite number of possible positions representing combinations of these two variables, there have been chosen forty-nine, each representing a discrete combination of one to seven lateral degree choices with one to seven vertical degree choices. Specific positional values for the lateral and vertical axes are obtained by potentiometers coupled to the respective drive motors 46 50. In addition, the vertical axis has a solenoid-activated pin lock 52 for each position.

In a second embodiment, the bottom 8 of the carriage 4 supports a rotatable support base 208 which supports a pivot post 216. A lateral drive motor 46 positions lateral drive linkages 218 which move the barrel 48 laterally by pivoting the barrel 48 around the pivot post 216. An elevational drive motor 50 moves a belt 220 and a drive pulley 222 which is connected to a side of the barrel 48 to lower or elevate the barrel 48. Also, the vertical position adjuster 214 moves in response to this motor 50 and, through a pin lock 52, gives stability to the elevation of the barrel 48. The lateral and vertical movements of the barrel 48 are produced by reversible electric motors 46 50 coupled by a timing belt 220 controlling the vertical declination and lateral drive linkages 218 controlling the lateral declination.

The internal processor coding for specific shot purposes presupposes a stable environment of those external factors that can affect ball trajectory. However, in order to compensate for an inevitable occasional change in those variables such as head wind opposing the projected balls 96 and/or a drop or surge in voltage at the blower 120 power source, the base support plate 208 on which the entire aiming mechanism 108 rests is hinged 226 at the rear 228 and fitted with an adjustment bolt 230 at the front 232 so that the vertical inclination angle of the barrel 48 can be increased (raised) or decreased (lowered) from any base setting to guarantee the ball 96 impact points called for by the microprocessor 40 shot codings.

Figure 58:
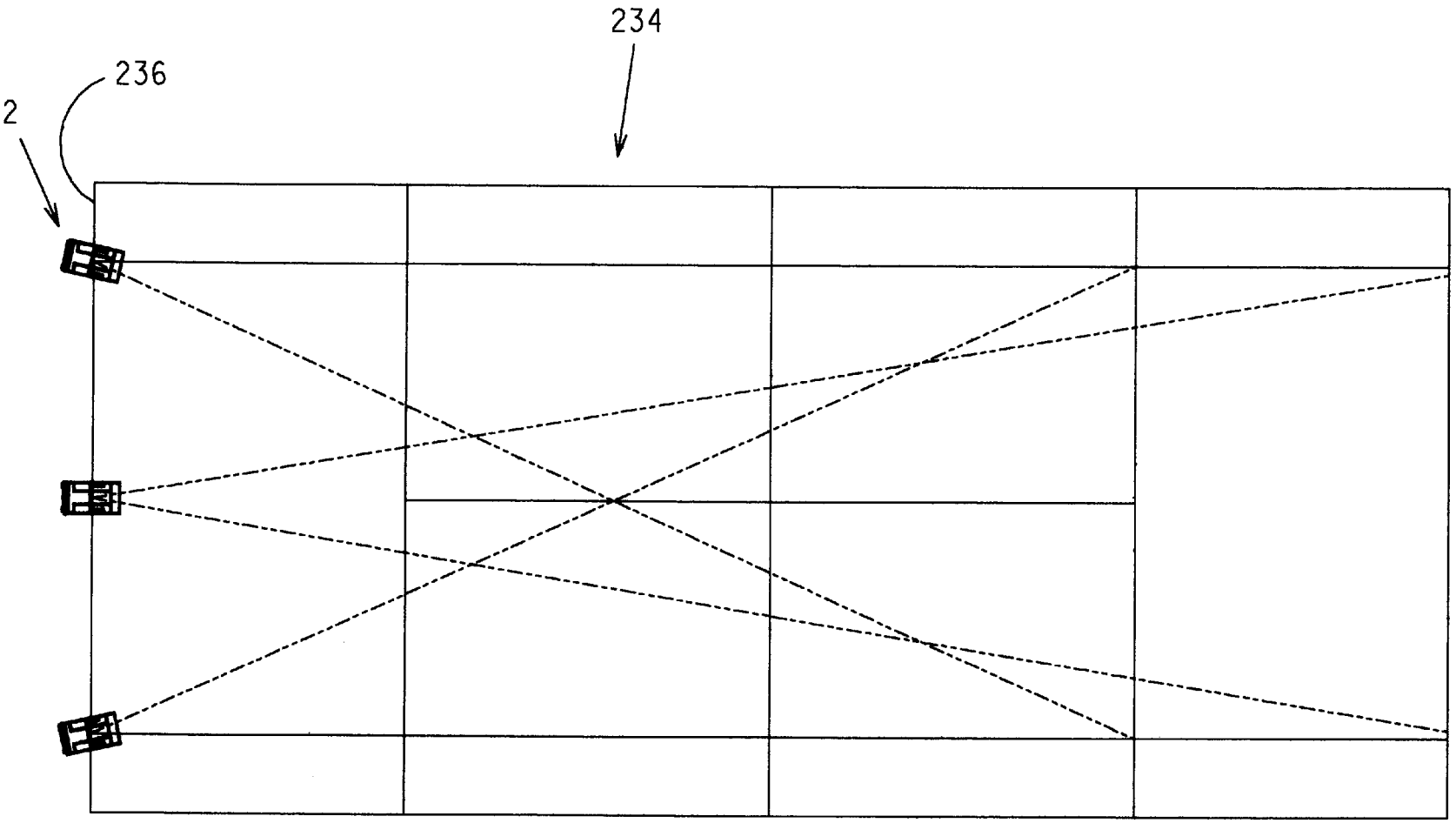
FIG. 58 is a top plan view of a tennis court having three of the devices of the invention set up in the preferred manner.

A single device 2 of the present invention may be used on a tennis court 234. However, in the most preferred embodiment, three devices 2 are used. In this embodiment, the devices are placed along a baseline 236 of a tennis court 234 in the configuration shown in FIG. 58. Using this configuration, all areas of the user's side of the tennis court 234 may receive projected balls 96 from manifold directions.

Figures 59, 60:
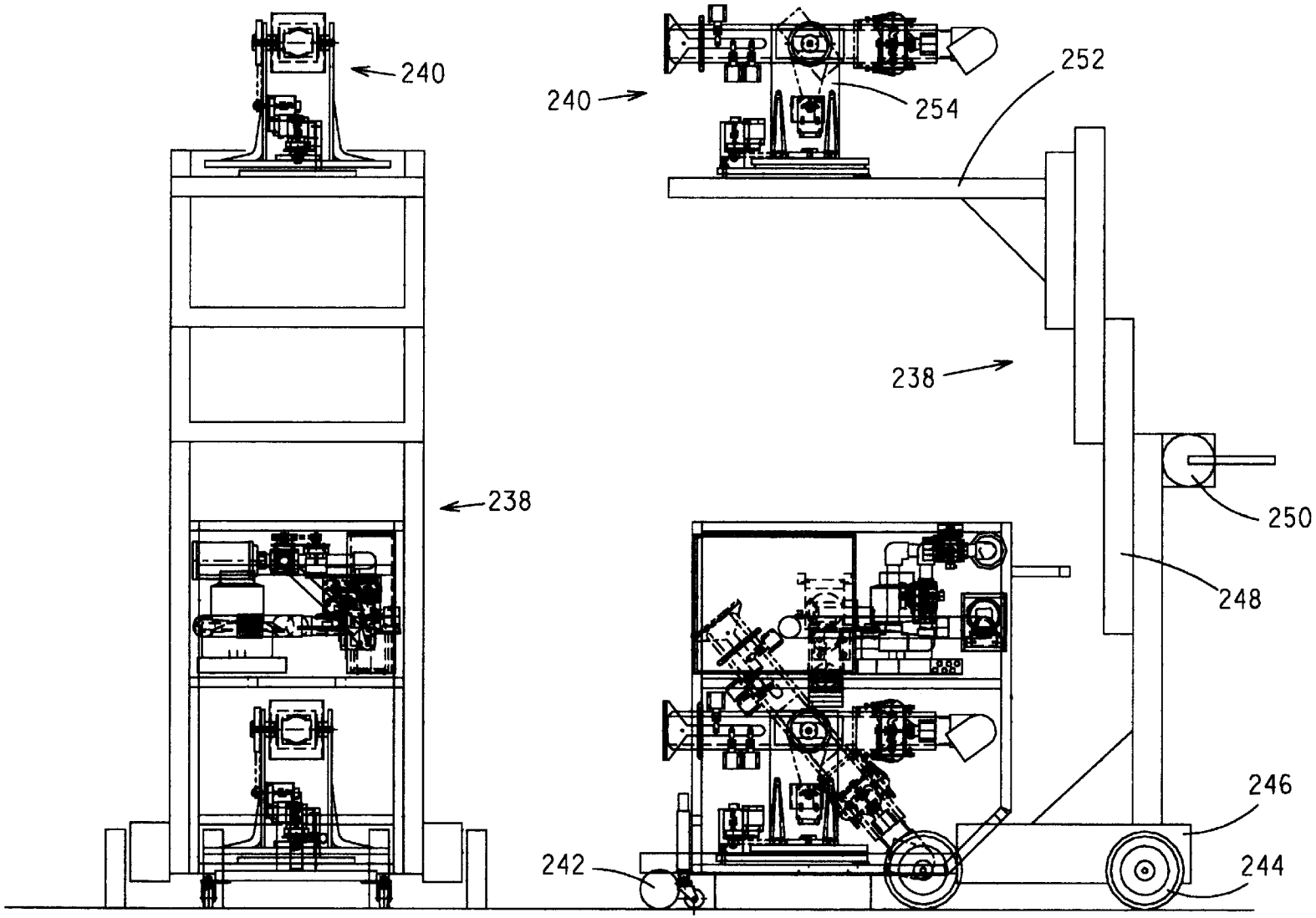
FIG. 59 is a front elevational view of the basic device of this invention coupled with a server of this invention to constitute a preferred device of this invention.
FIG. 60 is a side elevational view of the preferred device shown in FIG. 59.

The most complex, preferred embodiment of this invention will be described with reference to FIGS. 59 and 60. In the most preferred embodiment of this invention, there is at least one preferred device 238, which is made up of a basic device 2 straddled by a server apparatus 240. The server apparatus 240 may be a separate unit from the basic device 2 or may be physically attached to it to make up a preferred device 238. In the event of physical attachment, the server apparatus contains a large support wheel 242 in the front of the server apparatus 240. The server apparatus 240 is equipped with large rear wheels 244, a base platform 246, large front support wheels or smaller front casters 242, moveable risers 248 equipped with a motor or crank 250 for raising the risers, a support platform 252, and a ball projection mechanism 254. The extended risers 248 are of a height sufficient to propel a ball 96 from a height approximating that of a typically served ball 96. The ball projection mechanism 254 is served by the microprocessor 40 of the basic device 2 or a supervisor computer 104. As shown in FIGS. 59 and 60, the ball projection mechanism 254 has a barrel 48 and aiming mechanism 108. Balls 96 are provided from a hopper (not shown) which may be smaller than the hopper 62 for the basic device 2. The ball propulsion system may be the same as the pneumatic system 82 described in this invention or, since timing is not important, may be a system employing moving air. Use of the preferred device 238 offers a more realistic perception to the user as a ball coming from the server apparatus 240 more nearly simulates a ball coming from an actual server than does a ball coming from the basic device 2.

It can be seen that the tennis ball projecting devices 2 238 of this invention provide a realistic substitute for a human opponent and offers quality training, practice, and recreational opportunities. While this invention has been described in connection with a presently preferred embodiment thereof, many modifications and changes will occur to those skilled in the art without departing from the true spirit and scope of the invention, which accordingly, is intended to be limited solely by the appended claims.

I claim:

1. A device for projecting tennis balls comprising:

i) a carriage;

ii) a microprocessor;

iii) a computer-controlled pneumatic system comprising a blower, a by-pass valve, a pressure tank, and a series of course and fine air pressure valves for establishing air pressure within the pressure tank within narrow limits;

iv) a computer-controlled ball feeding system;

v) a barrel; and vi) a computer-controlled aiming mechanism comprising lateral and vertical aiming mechanisms.

2. The device of claim 1, wherein the carriage has a bottom and a support pad attached to the bottom of the carriage.

3. The device of claim 2, wherein the carriage has front and rear wheels and wherein the front wheels are adjustable so as to allow the carriage to roll or be supported by the support pad.

4. The device of claim 1, wherein the ball feeding mechanism includes a hopper for containing tennis balls, which hopper contains solenoid-activated pushers to agitate the balls.

5. The device of claim 1, wherein the ball feeding mechanism includes a hopper for containing tennis balls, which hopper contains a carousel having plurality of capturing sockets for the tennis balls, and which carousel contains a ball feeder point which contains a cover.

6. The device of claim 5, wherein the carousel advances only when a ball vacancy exists in a ball outlet tube which is directly under the ball feeder point.

7. The device of claim 6, wherein the ball outlet tube contains a ball sensing switch arm which controls the opening and closing of an electrical circuit such that when the ball in the feeder point drops, the switch arm is released, the circuit is closed and the carousel is advanced to feed another ball into the ball outlet tube, opening the circuit, and when the circuit is opened the carousel stops, preventing further ball feeding.

8. The device of claim 1, wherein a ball injection area connects the ball feeding system and the pneumatic system.

9. The device of claim 8, wherein the ball injection area contains a computer-controlled solenoid which controls a rotary sweep arm which controls the forcing of the ball through a flap door into a guide channel within the pressure tank.

10. The device of claim 9, wherein the rotary sweep arm is connected to an injector which forces the ball through a flap door, an upper surface of the injector being attached to a blocking plate which intervenes between the ball in the injection area and a following ball while the ball in the injection area is being forced through the flap door and which moves back to allow the following ball to enter the injection area in front of the injector once the ball in the injection area has passed into the pressure tank.

11. The device of claim 1, wherein the barrel contains a computer-controlled solenoid which controls a plurality of impeders spaced equally around the barrel such that compressed air behind a tennis ball will force the tennis ball against the impeders until they are released and, following release, propel the ball out of the barrel.

12. The device of claim 1, wherein the barrel has an open distal end and a computer-controlled solenoid which controls a spin plate mounted at the distal end of the barrel for imparting spin to a tennis ball leaving the barrel.

13. The device of claim 1, wherein the computer-controlled aiming mechanism comprises two support plates pivotally holding a barrel between them so that the barrel may be rotated in a vertical direction, the support plates being connected to a rotatable base so that the barrel may be rotated in a lateral direction.

14. The device of claim 13, wherein a computer-controlled lateral drive motor turns the rotatable base by means of a belt and pulley.

15. The device of claim 13, wherein the barrel is connected to a vertical position adjuster which is positioned by a computer-controlled vertical drive motor by means of a belt and pulley and locked in place by a spring-loaded pin-lock.

16. The device of claim 13, wherein the rotatable base rests upon a support plate having a front and a rear end, the rear end being hingedly connected to the bottom of the carriage and the front end is fitted with an adjustment bolt to allow for raising and lowering the angle of inclination of the support plate.

17. The device of claim 1, wherein the carriage has a bottom and computer-controlled aiming mechanisms comprising a support and pivot post attached to the carriage bottom, a lateral drive motor which controls the lateral movement of the barrel through lateral drive linkages, an elevational drive motor which controls the vertical movement of the barrel through vertical drive linkages, and a vertical position locking plate connected to the barrel and locked in place by means of a spring-loaded pin-lock.

18. A system for projecting tennis balls comprising the device of claim 1 in combination with a device for projecting tennis balls, which device comprises a microprocessor, a ball feeding means, a ball projection means, and a ball aiming means, which device is supported by a raised platform.

19. A device for projecting tennis balls comprising:

i) a carriage containing a hopper for the tennis balls;

ii) a microprocessor;

iii) a computer-controlled pneumatic system comprising means to obtain specific pressure;

iv) a computer-controlled ball feeding system which delivers balls from the hopper to the pneumatic system;

v) a barrel through which the tennis balls are projected, which barrel comprises;

A) a proximal end,

B) a distal end,

C) a plurality of impeders spaced around the barrel, which impeders are capable of pivotally entering the barrel to prevent distal motion of a ball and are capable of pivotally exiting the barrel to allow distal motion of a ball, D) a computer-controlled solenoid which controls the distal and proximal motion of a sliding sleeve containing rollers such that when the sliding sleeve moves distally the impeders are released and are forced out of the barrel allowing distal projection of the ball, and when the sliding sleeve moves proximally the impeders are again locked in place in the barrel preventing distal motion of a ball;

vi) a computer-controlled aiming mechanism comprising lateral and vertical aiming mechanisms.

20. The device of claim 19, wherein the impeders contain rounded, notched edges and axles which are attached to the barrel and contain springs which return the impeders to the locking position in the barrel, the computer-controlled solenoid located on the barrel is attached through linking means to the first end of a yoke, and controls the distal and proximal movement of the first end of the yoke, the yoke being pivotally attached to the barrel, a second end of the yoke is attached to a spring which tends to force the second end of the yoke proximally along the barrel, the second end of the yoke also being pivotally attached to a proximal end of a release rod, the release rod being attached to a sliding locking sleeve containing rollers such that when the impeders are in place in the barrel impeding the progress of a ball, the proximal movement of the first end of the yoke by action of the computer-controlled solenoid forces the second end of the yoke distally, forcing the release rod distally, forcing the sliding sleeve distally, moving the rollers out of the notches in the impeders, and allowing the impeders to rotate out of the barrel, thus releasing the tennis ball.

21. A system for projecting tennis balls comprising the device of claim 19 in combination with a device for projecting tennis balls, which device comprises a microprocessor, a ball feeding means, a ball projection means, and a ball aiming means, which device is supported by a raised platform.

* * * * *

UNITED STATES PATENT AND TRADEMARK OFFICE

CERTIFICATE OF CORRECTION

PATENT NO. : 6,085,735
DATED : July 11, 2000
INVENTOR(S) : John H. Cheek, Jr.

It is certified that error appears in the above-identified patent and that said Letters Patent is hereby corrected as shown below:

Column 8,
Starting at line 42, "The microprocessor input mechanism contains numerical keys 112, mode keys 114, and function keys 116 of." should read -- The microprocessor input mechanism contains numerical keys 112, mode keys 114, and function keys 116 for the control of functions such as speed and placement of the ball 96, timing between shots, and spin. --
Line 56, "an arc of 190" should read -- an arc of 19° --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*